US010479585B2

(12) United States Patent
Seiders et al.

(10) Patent No.: US 10,479,585 B2
(45) Date of Patent: Nov. 19, 2019

(54) CONTAINER WITH MAGNETIC CAP AND CONTAINER HOLDER

(71) Applicant: YETI Coolers, LLC, Austin, TX (US)

(72) Inventors: Roy Joseph Seiders, Austin, TX (US); John Alan Tolman, Austin, TX (US); Steve Charles Nichols, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 166 days.

(21) Appl. No.: 15/434,944

(22) Filed: Feb. 16, 2017

(65) Prior Publication Data

US 2017/0158412 A1 Jun. 8, 2017

Related U.S. Application Data

(63) Continuation-in-part of application No. 14/826,612, filed on Aug. 14, 2015, now Pat. No. 10,093,460.

(51) Int. Cl.
*B65D 81/38* (2006.01)
*B65D 23/10* (2006.01)
(Continued)

(52) U.S. Cl.
CPC ..... *B65D 81/3841* (2013.01); *B65D 1/0246* (2013.01); *B65D 23/106* (2013.01); *B65D 23/108* (2013.01); *B65D 25/2835* (2013.01); *B65D 25/2864* (2013.01); *B65D 25/40* (2013.01); *B65D 41/04* (2013.01); *B65D 41/34* (2013.01); *B65D 43/02* (2013.01); *B65D 43/0229* (2013.01); *B65D 47/14* (2013.01); *B65D 47/142* (2013.01); *B65D 51/18* (2013.01); *B65D 51/242* (2013.01); *B65D 55/16* (2013.01); *B65D 81/3837* (2013.01); *B65D 81/3869* (2013.01); *B65D 2251/009* (2013.01);
(Continued)

(58) Field of Classification Search
CPC ..... A47G 23/0241; A47G 23/02; B65D 41/0414; A47J 41/0011
USPC ..... 220/741
See application file for complete search history.

(56) References Cited

U.S. PATENT DOCUMENTS 1,477,936 A 12/1923 Bolt
D101,575 S 10/1936 Windbiel
(Continued)

FOREIGN PATENT DOCUMENTS

CN 301110494 1/2010
CN 202060630 U 12/2011
(Continued)

OTHER PUBLICATIONS

"2015 Boulder Insulated Water Bottle with Tea, Fruit, Ice Strainer" published on Jun. 28, 2015, retrieved from http://web.archive.org/web/*/http://www.ecovessel.com/boulder-insulated-water-bottle-with-tea-fruit-ice-strainer-20-oz/ on Sep. 22.
(Continued)

*Primary Examiner* — Jeffrey R Allen
(74) *Attorney, Agent, or Firm* — Banner & Witcoff, Ltd.

(57) ABSTRACT

A container having a canister can be configured to retain a volume of liquid. The container can be sealed by a lid structure and the lid structure may include a rotatable handle. The container may further have a holder used to engage the container and the holder and container may be configured to lock to each other.

16 Claims, 20 Drawing Sheets

(51) Int. Cl.

| | |
|---|---|
| ***B65D 41/34*** | (2006.01) |
| ***B65D 43/02*** | (2006.01) |
| ***B65D 1/02*** | (2006.01) |
| ***B65D 47/14*** | (2006.01) |
| ***B65D 51/18*** | (2006.01) |
| ***B65D 25/28*** | (2006.01) |
| ***B65D 25/40*** | (2006.01) |
| ***B65D 41/04*** | (2006.01) |
| ***B65D 51/24*** | (2006.01) |
| ***B65D 55/16*** | (2006.01) |

(52) U.S. Cl.

CPC ..... *B65D 2251/0015* (2013.01); *B65D 2251/0025* (2013.01); *B65D 2251/0028* (2013.01); *B65D 2251/0081* (2013.01); *B65D 2251/0087* (2013.01); *B65D 2313/04* (2013.01); *B65D 2525/283* (2013.01); *B65D 2543/00351* (2013.01)

(56) References Cited

U.S. PATENT DOCUMENTS

D109,331 S 4/1938 McManus et al.
D154,378 S 7/1949 Fuller
D177,761 S 5/1956 Reinhardt
2,804,103 A 8/1957 Wall
2,957,596 A 10/1960 Rehborg
2,963,187 A 12/1960 Bramming
3,089,603 A 5/1963 Leslie-Smith
3,239,090 A * 3/1966 Bramming ..... A47J 41/0011 215/12.1
3,456,840 A * 7/1969 McAlaster ..... A47G 23/0258 220/741
3,592,349 A 7/1971 Baugh
D224,646 S 8/1972 Vollquartz
3,752,347 A 8/1973 Bell
3,785,539 A 1/1974 Wetterek
D235,303 S 6/1975 Boucher
D248,373 S 7/1978 Allen
D256,651 S 9/1980 Leung et al.
D279,346 S 6/1985 Ruxton
D281,567 S 12/1985 Zimmermann
D286,604 S 11/1986 Bierlein et al.
D286,847 S 11/1986 Zimmermann
D287,211 S 12/1986 Weiss
D289,614 S 5/1987 Sanchez et al.
D292,492 S 10/1987 Ross et al.
4,723,677 A 2/1988 Nagel, Jr.
4,981,233 A 1/1991 Scheurer
D321,628 S 11/1991 Kobayashi et al.
D332,379 S 1/1993 Murphy
5,190,178 A 3/1993 Luch
5,211,299 A 5/1993 Manfredonia
5,232,112 A 8/1993 Howard
5,251,788 A 10/1993 Moore
D354,915 S 1/1995 Schneider et al.
D361,265 S 8/1995 Doxey
D368,224 S 3/1996 Arndt
5,498,333 A 3/1996 Canther
5,605,241 A 2/1997 Imperioli
D384,280 S 9/1997 Kuczer
D398,193 S 9/1998 Sanchez
5,813,557 A 9/1998 Oratz
D402,510 S 12/1998 Miller
D405,642 S 2/1999 Toriba
D405,650 S 2/1999 Meier
D407,211 S 3/1999 Diviak, Sr.
D407,273 S 3/1999 Moran
D410,175 S 5/1999 Moran
D415,395 S 10/1999 Hunt et al.
D415,936 S 11/1999 Moran
D422,916 S 4/2000 Herrmann
6,079,589 A 6/2000 Matsuyama et al.
D437,528 S 2/2001 Kitamura et al.
6,264,072 B1 7/2001 Johannes
D447,410 S 9/2001 Malmborg
6,321,924 B1 11/2001 Yurkewicz et al.
6,332,557 B1 12/2001 Moran
D456,669 S 5/2002 Munari
D458,133 S 6/2002 Berish et al.
D458,134 S 6/2002 Berish et al.
D466,814 S 12/2002 Hurlburt
6,530,496 B2 3/2003 Moran
D475,924 S 6/2003 Haffner
D476,890 S 7/2003 Hirose
D479,800 S 9/2003 McRae
D482,607 S 11/2003 McRae
6,648,158 B1 11/2003 Lawrence
6,651,838 B2 * 11/2003 Bissell ..... B65D 23/106 215/395
D490,275 S 5/2004 Moran
D494,425 S 8/2004 Segura
D524,909 S 7/2006 Bakke et al.
D525,518 S 7/2006 Baldwin
D530,141 S 10/2006 Wilgus et al.
D533,032 S 12/2006 Liu et al.
D536,929 S 2/2007 Kingsley
7,172,101 B2 2/2007 Find
D537,714 S 3/2007 Yerby et al.
D540,625 S 4/2007 Sandberg
D548,082 S 8/2007 Kingsley
D549,444 S 8/2007 Schnackenberg
7,270,244 B1 9/2007 Liu
D553,914 S 10/2007 Wahl
D554,000 S 10/2007 Walsh
D557,994 S 12/2007 Wahl
D564,363 S 3/2008 Rhea
D567,007 S 4/2008 Bodum
D569,195 S 5/2008 Kim
D572,585 S 7/2008 Perrin et al.
D574,237 S 8/2008 Yates, III
D583,200 S 12/2008 Moran
7,458,486 B2 12/2008 Weist et al.
D584,623 S 1/2009 Chupak
D586,183 S 2/2009 Junkel
D587,533 S 3/2009 Carreno
D589,348 S 3/2009 Miller et al.
D599,616 S 9/2009 Cresswell et al.
D601,436 S 10/2009 Stephens et al.
D603,331 S 11/2009 Schupp
D603,722 S 11/2009 Reimer
D604,181 S 11/2009 Reimer
D604,561 S 11/2009 Chisholm
D605,040 S 12/2009 Fry et al.
D605,060 S 12/2009 Reimer
D605,942 S 12/2009 Miksovsky
D610,871 S 3/2010 Alviar et al.
D611,346 S 3/2010 Camomile
D612,235 S 3/2010 Cresswell et al.
D612,660 S 3/2010 Bodum
D614,918 S 5/2010 Chisholm
D615,360 S 5/2010 Joy et al.
D615,361 S 5/2010 Goble
D615,816 S 5/2010 Joy et al.
D616,703 S 6/2010 Joy et al.
D616,743 S 6/2010 Cresswell et al.
D616,744 S 6/2010 Cresswell et al.
D619,457 S 7/2010 Walsh
D619,458 S 7/2010 Walsh
D619,459 S 7/2010 Walsh
D620,798 S 8/2010 Cresswell et al.
D621,257 S 8/2010 Gullickson et al.
D621,258 S 8/2010 Gullickson et al.
D622,089 S 8/2010 Daniel et al.
D622,145 S 8/2010 Walsh
D623,475 S 9/2010 Aarnoudse et al.
D623,480 S 9/2010 Moran
D623,481 S 9/2010 Moran
D625,560 S 10/2010 Olson et al.
D626,414 S 11/2010 Cresswell et al.
D626,416 S 11/2010 Cresswell et al.
D627,601 S 11/2010 Eyal
D627,602 S 11/2010 Eyal

(56) References Cited

U.S. PATENT DOCUMENTS

D627,604 S 11/2010 Eyal
D628,018 S 11/2010 Gilbert
D628,486 S 12/2010 Lane
D628,898 S 12/2010 Barnett et al.
D628,900 S 12/2010 Barnett et al.
D628,901 S 12/2010 Barnett et al.
D629,689 S 12/2010 Cresswell et al.
D629,690 S 12/2010 Cresswell et al.
D629,691 S 12/2010 Cresswell et al.
D630,474 S 1/2011 Gilbert
D630,475 S 1/2011 Lu
D631,349 S 1/2011 Arnell et al.
7,870,968 B2 1/2011 Hanson
D631,666 S 2/2011 Lim et al.
D633,338 S 3/2011 Rosbach et al.
D633,794 S 3/2011 Cresswell et al.
D633,795 S 3/2011 Cresswell et al.
D633,796 S 3/2011 Cresswell et al.
D633,797 S 3/2011 Cresswell et al.
D634,160 S 3/2011 Cetera
D635,457 S 4/2011 Lane
D635,856 S 4/2011 Lauret
D638,695 S 5/2011 Woodrow et al.
D638,708 S 5/2011 Walsh
D639,164 S 6/2011 Walsh
D639,177 S 6/2011 Pape
D639,661 S 6/2011 Llerena
D639,663 S 6/2011 Llerena
D640,466 S 6/2011 Staton
D641,591 S 7/2011 Tsukida
D643,691 S 8/2011 Selina et al.
D643,693 S 8/2011 Jama
D645,709 S 9/2011 Endo
8,011,535 B2 9/2011 Tauber et al.
D648,984 S 11/2011 Gullickson et al.
D651,050 S 12/2011 Goshi
D651,847 S 1/2012 Gilbert
D652,255 S 1/2012 Carland
D652,682 S 1/2012 Eyal
D653,499 S 2/2012 Dietterle et al.
D654,762 S 2/2012 Gilbert
D655,134 S 3/2012 Gilbert
D655,581 S 3/2012 Kotani
D657,196 S 4/2012 Beyers, III
D658,064 S 4/2012 Barnes et al.
D658,445 S 5/2012 Carreno
D659,007 S 5/2012 Pape
D660,084 S 5/2012 Gilbert
8,177,097 B2 5/2012 Duran
D662,360 S 6/2012 George
8,210,572 B2 7/2012 Davis
8,215,511 B1 7/2012 Lin
D664,809 S 8/2012 Eyal
D665,621 S 8/2012 Eyal
8,245,600 B2 8/2012 Beard
8,245,870 B2 8/2012 McKinney et al.
8,251,247 B1 * 8/2012 Breckner ..... A47G 23/0266 220/592.16
D666,908 S 9/2012 Dabah et al.
D668,913 S 10/2012 Mayer
D670,137 S 11/2012 Gilbert
D671,372 S 11/2012 Zou
D672,238 S 12/2012 Aziz et al.
D672,609 S 12/2012 Aziz et al.
D673,459 S 1/2013 Moran, Sr.
D675,100 S 1/2013 Herbst
D676,764 S 2/2013 Moore et al.
D677,103 S 3/2013 Melzer
D677,119 S 3/2013 Ying
D678,729 S 3/2013 Peeters et al.
D678,772 S 3/2013 Johnson et al.
D679,185 S 4/2013 Brown et al.
D680,389 S 4/2013 Zemel et al.
D682,016 S 5/2013 Knight
D682,617 S 5/2013 Miksovsky et al.
8,443,993 B1 5/2013 Desselle
8,443,994 B1 5/2013 Desselle
D684,059 S 6/2013 Johnson et al.
D686,078 S 7/2013 Johnson et al.
D688,093 S 8/2013 Roth et al.
8,505,760 B2 8/2013 Ott
8,505,787 B2 8/2013 Fox et al.
D690,987 S 10/2013 Gallen
D693,698 S 11/2013 Miller, Jr.
8,584,902 B2 11/2013 Dejonge
D695,138 S 12/2013 Ball
8,613,369 B2 12/2013 Kitto
D696,945 S 1/2014 Newman
D697,404 S 1/2014 Johnson et al.
D697,802 S 1/2014 Lane
8,622,229 B2 1/2014 Lane
D698,668 S 2/2014 Vaughn
D701,464 S 3/2014 Ogata et al.
D702,092 S 4/2014 Mettler et al.
D702,506 S 4/2014 Mettler et al.
8,695,822 B2 4/2014 Kwon
8,701,881 B2 4/2014 Gibson et al.
8,701,924 B2 4/2014 Dalbec
8,708,176 B2 4/2014 Andis
8,720,730 B2 5/2014 Bodden, Jr.
8,752,720 B1 6/2014 Habig et al.
D708,484 S 7/2014 Bishop
D708,914 S 7/2014 Moran, Sr.
D708,954 S 7/2014 Barnes et al.
D709,734 S 7/2014 Kotani
D712,254 S 9/2014 Geis et al.
D712,255 S 9/2014 Geis et al.
D713,268 S 9/2014 Jones et al.
D713,365 S 9/2014 Green
8,833,586 B2 9/2014 Meyers et al.
D714,584 S 10/2014 Boroski
D717,102 S 11/2014 Taketani et al.
D719,780 S 12/2014 Sullivan
8,905,252 B2 12/2014 Latham et al.
D724,385 S 3/2015 Hurley et al.
D728,315 S 5/2015 Bo
D728,995 S 5/2015 Barberi
D729,579 S 5/2015 Molayem
D729,584 S 5/2015 Weston et al.
D732,402 S 6/2015 Jones et al.
D734,154 S 7/2015 Johnson et al.
D735,033 S 7/2015 Lynd et al.
D735,578 S 8/2015 Mazurkiewicz et al.
9,113,698 B2 8/2015 Blain et al.
9,126,731 B2 9/2015 Chen
D741,655 S 10/2015 Whelan et al.
D743,742 S 11/2015 Rummel et al.
D744,781 S 12/2015 Rummel et al.
9,205,445 B2 12/2015 Fang et al.
D748,955 S 2/2016 Oliver
D751,898 S 3/2016 D'Anglade
9,272,822 B2 3/2016 Samartgis
D754,472 S 4/2016 Munari
D755,561 S 5/2016 Eyal
D757,543 S 5/2016 Sorensen et al.
D758,136 S 6/2016 Liotta et al.
D758,790 S 6/2016 Boroski
D758,791 S 6/2016 Hanna et al.
D758,804 S 6/2016 Liotta et al.
D759,487 S 6/2016 Jayakaran
9,376,243 B2 6/2016 Cerveny
D760,586 S 7/2016 Seiders et al.
D761,624 S 7/2016 McLean et al.
D762,418 S 8/2016 Sorensen et al.
D763,076 S 8/2016 Lane et al.
D767,390 S 9/2016 Miksovsky et al.
D772,021 S 11/2016 Joy
D772,652 S 11/2016 Yao
D772,718 S 11/2016 Lee
9,493,283 B2 11/2016 Tuyn
D773,938 S 12/2016 Weber
D774,826 S 12/2016 Boroski
D778,117 S 2/2017 Du
D778,118 S 2/2017 Du

(56) References Cited

U.S. PATENT DOCUMENTS

| | | | |
|---|---|---|---|
| D778,725 | S | 2/2017 | Sorensen et al. |
| 9,586,733 | B2 | 3/2017 | Garza |
| D784,812 | S | 4/2017 | Miller |
| D787,893 | S | 5/2017 | Seiders et al. |
| D790,913 | S | 7/2017 | Stover et al. |
| D791,542 | S | 7/2017 | Miksovsky et al. |
| 9,771,189 | B2 | 9/2017 | Miksovsky et al. |
| D799,269 | S | 10/2017 | Vargo |
| D799,909 | S | 10/2017 | Partridge |
| D799,963 | S | 10/2017 | Akiyama |
| D802,375 | S | 11/2017 | Kao |
| D802,419 | S | 11/2017 | Seiders et al. |
| D806,465 | S | 1/2018 | Boroski |
| 2003/0155323 | A1 | 8/2003 | Ekkert |
| 2004/0016715 | A1 | 1/2004 | Strikovic |
| 2004/0206721 | A1 | 10/2004 | Swanberg et al. |
| 2005/0274741 | A1 | 12/2005 | Cho |
| 2006/0180585 | A1 | 8/2006 | Cunningham et al. |
| 2007/0108153 | A1 | 5/2007 | Weist |
| 2007/0199914 | A1 | 8/2007 | Hung |
| 2007/0251956 | A1 | 11/2007 | Wasserman et al. |
| 2008/0142466 | A1 | 6/2008 | Balitski |
| 2010/0089151 | A1 | 4/2010 | Mantilla et al. |
| 2010/0215294 | A1 | 8/2010 | Berman |
| 2011/0056386 | A1 | 3/2011 | Taketani |
| 2011/0186585 | A1 | 8/2011 | Lu |
| 2012/0074143 | A1 | 3/2012 | Lin |
| 2012/0199548 | A1 | 8/2012 | Kitto |
| 2013/0136382 | A1 | 5/2013 | Barron |
| 2013/0306642 | A1 | 11/2013 | Dabah et al. |
| 2014/0069917 | A1 | 3/2014 | Meyers et al. |
| 2014/0251938 | A1 | 9/2014 | Rose et al. |
| 2014/0312077 | A1 | 10/2014 | Tajima et al. |
| 2014/0353275 | A1 | 12/2014 | Hung |
| 2015/0191293 | A1 | 7/2015 | Forcella |
| 2015/0251812 | A1 | 9/2015 | Gillie |
| 2015/0314929 | A1 | 11/2015 | Tebbe et al. |
| 2016/0159538 | A1 | 6/2016 | Michie |
| 2016/0167852 | A1 | 6/2016 | Moradi |
| 2016/0176587 | A1 | 6/2016 | Heraud |
| 2016/0256359 | A1 | 9/2016 | Trawick et al. |
| 2016/0318693 | A1* | 11/2016 | Hein ..... B65D 41/0442 |
| 2016/0355305 | A1 | 12/2016 | Hoskins |
| 2017/0001772 | A1 | 1/2017 | Rho |
| 2017/0127859 | A1 | 5/2017 | Hornung et al. |
| 2017/0158398 | A1 | 6/2017 | Shively |
| 2017/0158412 | A1 | 6/2017 | Seiders et al. |
| 2017/0354289 | A1 | 12/2017 | Marina et al. |
| 2018/0029762 | A1 | 2/2018 | Eyal |

FOREIGN PATENT DOCUMENTS

| | | | |
|---|---|---|---|
| CN | 103538798 | A | 1/2014 |
| CN | 303528321 | | 12/2015 |
| CN | 303894653 | | 10/2016 |
| CN | 303899030 | | 10/2016 |
| CN | 303902404 | | 11/2016 |
| CN | 303905254 | | 11/2016 |
| CN | 303905266 | | 11/2016 |
| CN | 303944047 | | 11/2016 |
| CN | 303956194 | | 12/2016 |
| CN | 303965272 | | 12/2016 |
| CN | 303965286 | | 12/2016 |
| CN | 303965392 | | 12/2016 |
| CN | 303965400 | | 12/2016 |
| CN | 303966239 | | 12/2016 |
| CN | 303974938 | | 12/2016 |
| CN | 303984407 | | 12/2016 |
| CN | 303984493 | | 12/2016 |
| CN | 304011213 | | 1/2017 |
| CN | 304011214 | | 1/2017 |
| CN | 205998332 | U | 3/2017 |
| DE | 2233565 | A1 | 6/1973 |
| DE | 29611746 | U1 | 11/1997 |
| DE | 102014011506 | B3 | 7/2015 |
| DK | 402016101176-0008 | | 11/2016 |
| DK | 402016101176-0010 | | 11/2016 |
| EM | 003528504-0004 | | 12/2016 |
| EP | 1934106 | A1 | 6/2008 |
| FR | 2786465 | | 6/2000 |
| JP | 2001315831 | A | 11/2001 |
| JP | 2008162679 | A | 7/2008 |
| JP | 1363566 | | 6/2009 |
| JP | 1530358 | | 8/2015 |
| KR | 300295354 | | 4/2002 |
| KR | 300303813.0000 | | 8/2002 |
| KR | 300751936.0000 | | 7/2014 |
| KR | 300764889.0000 | | 10/2014 |
| KR | 300883384.0000 | | 11/2016 |
| KR | 300884377.0000 | | 12/2016 |
| KR | 300885455.0000 | | 12/2016 |
| KR | 300885851.0000 | | 12/2016 |
| RU | 00100680 | | 11/2016 |
| WO | 2005028317 | A2 | 3/2005 |
| WO | 2006023238 | A2 | 3/2006 |
| WO | 07123365 | A1 | 11/2007 |
| WO | 08048039 | A1 | 4/2008 |
| WO | O088688-002 | | 1/2016 |

OTHER PUBLICATIONS

"64 oz Double-Wall Vacuum-Insulated Growler" published on Nov. 14, 2014, retrieved from https://web.archive.org/web/*/http://www.fiftyfiftybottles.com/64oz-growler/ on Sep. 22, 2016.

"Eco Vessel 64 ounce Growler" published on Jan. 28, 2015, retrieved from http://web.archive.org/web/*/http://www.snewsnet.com/press-release/eco-vessel-launches-the-boss-insulated-growler/ on Sep. 22, 2016.

"Hydro Flask Insulated Stainless Steel Water Bottle" published on Dec. 29, 2014, retrieved from http://web.archive.org/web/*/https://www.amazon.com/dp/B004X55L9I/ref=twister_B00GA03LG4?_encoding=UTF8&psc=1 on Sep. 22, 2016.

"KB8 20 oz. Double Wall Stainless Bottle," published on May 22, 2015, retrieved from https://web.archive.org/web/20150807054814/http://thermo-steel.com/work/keen-kb8 on Sep. 27, 2016.

"Klean Kanteen Insulated Classic with Polypropylene" published on Jul. 7, 2015, retrieved from http://web.archive.org/web/*/https://www.lifewithoutplastic.com/store/klean-kanteen-insulated-classic-with-polypropylene-loop-cap-0-95-I-32-oz.html on Sep. 22, 2016.

"UA Beyond 18 oz. Vacuum Insulated Water Bottle" published on Mar. 29, 2015, retrieved from http://web.archive.org/web/*/https://www.underarmour.com/en-us/beyond-18-oz-vacuum-insulated-ss-bottle-with-flip-top-lid/pid1232014 on Sep. 22, 2016.

Nov. 1, 2016—(JP) Office Action—App. 2016-9606, English Translation, 2 Pages.

Nov. 2, 2016—(WO) International Search Report and Written Opinion—App. No. PCT/US2016/047043—12 pages.

Oct. 4, 2016—(JP) Office Action—App 2016-9607, English Translation, 2 pages.

Oct. 4, 2016—(JP) Office Action—App. 2016-9608, English Translation, 2 Pages.

Oct. 18, 2016—(JP) Office Action—App. 2016-010799, English Translation, 3 Pages.

Oct. 18, 2016 (JP) Office Action—App. 2016-010800, English Translation, 3 Pages.

KOLD Vacuum Insulated Stainless Steel Sports Bottle: Announced Dec. 8, 2015 [online], site visited [May 11, 2016]. Available from Internet URL: http://www.amazon.com/KOLD-Sports-Water-Bottles-Insulated/dp/B018YH K79E/ref=cm.

Liquid Hardware, Insulated Aqua Silver Sidewinder Vacuum Bottle 20oz./592ml. Powder Coated in USA!, product description, retrieved from Internet on Aug. 12, 2015, 3 pages.

Yeti 36 oz. Rambler: Announced Jan. 11, 2016 [online], site visited [May 10, 2016]. Available from Internet URL: http://yeticoolers.com/rambler-bottle-36-oz/.

Rambler Jug Mount. Online, published date unknown. Retrieved on Jan. 2, 2018 from URL: https://www.yeti.com/accessories/rambler-jug-mount!YRAMJM.html.

(56) References Cited

OTHER PUBLICATIONS

Jan. 29, 2018—(WO) Invitation to Pay Additional Fees and Partial International Search Report—App. No. PCT/US2017/057010—13 pages.
Mar. 27, 2018—(WO) International Search Report and Written Opinion—App. No. PCT/US2017/057010—19 pages.
Avex, "40oz. 3Sixty Pour Stainless Steel Thermal Bottle", Accessed May 18, 2017. http://www.avexoutdoor.com/3sixty-pour-realtree-thermal-bottle.html.
"First Look: Yeti Rambler One Gallon 'Jug' Review". Found online Jun. 12, 2017 at gearjunkie.com. Page dated May 2, 2017. Retrieved from https://gearjunkie.com/yeti-rambler-one-gallon-jug-review.
"Lifefactory Water Bottle with Flip Cap". Found online Oct. 26, 2016 at amazon.com. Page dated Jan. 21, 2012. Retrieved from https://www.amazon.com/Lifefactory-22-Ounce-BPA-Free-Bottle-Silicone/dp/B01JIHJYOI/ref=pd_day0_79_22?_encoding=UTH8&refRID=YW47C2073YFSYXXEHXG2.
"Igloo Sport Beverage Cooler". Found online Jun. 7, 2017 at amazon.com. Page dated Mar. 9, 2013. Retrieved from https://www.amazon.com/Igloo-Beverage-Cooler-Majestic-2-Gallon/dp/B0088AYPOG/ref=cm_cr_arp_d_product_top?e=UTF8.
"Klear Loop Cap Hangle Lids for Klear Bottle and Hydro Flask". Found online Jun. 7, 2017 at amazon.com. Page dated Jul. 4, 2016. Retrieved from https://www.amazon.com/Klear-Handle-Bottle-Hydro-Flask/dp/B01EXKSRLQ/ref=cm_cr_arp_d_product_top?ie=UTF8.

* cited by examiner

CONTAINER WITH MAGNETIC CAP AND CONTAINER HOLDER

CROSS REFERENCE TO RELATED APPLICATIONS

This application is a continuation-in-part application of pending U.S. patent application Ser. No. 14/826,612 filed Aug. 14, 2015, the disclosure of which is hereby incorporated by reference in its entirety.

BACKGROUND

A container may be configured to store a volume of liquid. In one example, an opening in the container may be sealed with a removable cap. As such, in order to extract the liquid from the container, the cap may first be manually removed and set aside.

BRIEF SUMMARY

In certain examples, an insulating container may have a canister, which can include an insulated double wall, a first end to support the canister on a surface, a second end, and a sidewall. The canister may also have an opening in the second end that extends through the insulated double wall. A neck structure may encircle the opening and extend in an axial direction.

In certain examples, a lid may seal the opening of the canister, with the a threaded sidewall of the lid received into the neck structure of the canister. The lid may also have a circular domed top surface having a spout opening, and a removable cap that seals the spout opening. Further, the cap may have a magnetic top surface configured to be magnetically attracted to, and retained within, an optional dimple on the domed top surface.

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

BRIEF DESCRIPTION OF THE DRAWINGS

The present invention is illustrated by way of example and not limited in the accompanying figures in which like reference numerals indicate similar elements and in which.

Further, it is to be understood that the drawings may represent the scale of different components of one single embodiment; however, the disclosed embodiments are not limited to that particular scale.

DETAILED DESCRIPTION

Aspects of this disclosure relate to a container configured to store a volume of liquid. In one example, the container may have a spout opening that is sealed with a removable cap. Accordingly, the removable cap may be configured with a magnetic top surface such that when removed, the cap may be magnetically affixed to one or more surfaces of the container for temporary storage while the liquid is being poured from the container.

In the following description of the various embodiments, reference is made to the accompanying drawings, which form a part hereof, and in which is shown by way of illustration various embodiments in which aspects of the disclosure may be practiced. It is to be understood that other embodiments may be utilized and structural and functional modifications may be made without departing from the scope and spirit of the present disclosure.

Figure 1:
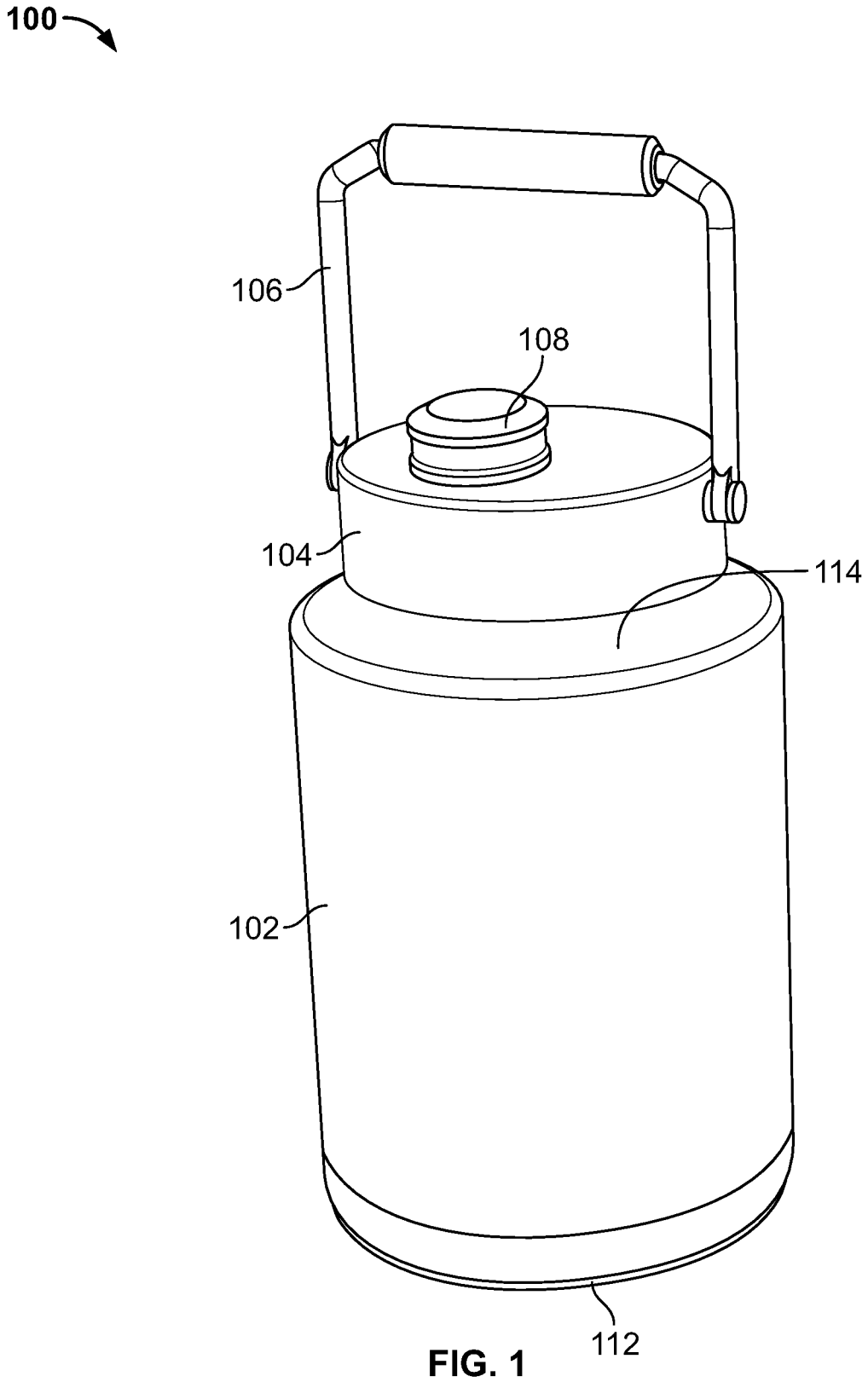
FIG. 1 depicts an isometric view of an example container, according to one or more aspects described herein.
Figure 3:
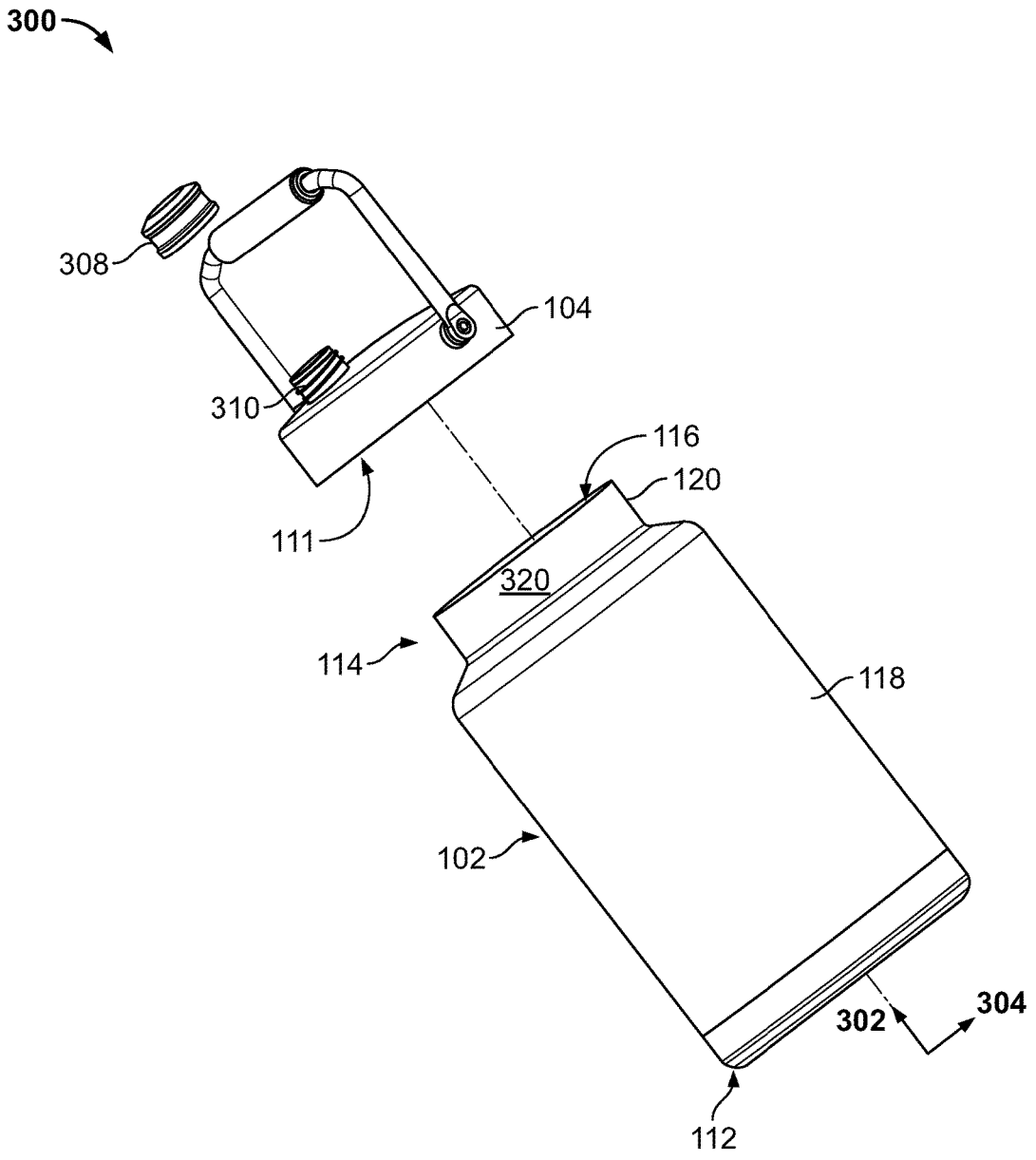
FIG. 3 depicts an exploded isometric view of another example container, according to one or more aspects described herein.

FIG. 1 depicts an isometric view of a container 100. In one example, container 100 may comprise a bottom portion 102 having a lid 104 removably coupled thereto. In one example, the bottom portion 102 may be substantially cylindrical in shape. In various examples, bottom portion 102 may be referred to as a canister 102, or base 102. The bottom portion 102 may, alternatively, be referred to as an insulated base structure having a substantially cylindrical shape, and having an opening 116 in one end 114 as shown in FIG. 3. In another example to that implementation depicted FIG. 1, the bottom portion 102 may be substantially cuboidal, or prismoidal (e.g. a pentagonal prism, hexagonal prism, heptagonal prism, among others) in shape. In one implementation, the lid 104 may comprise a carry handle structure 106.

Figure 2:
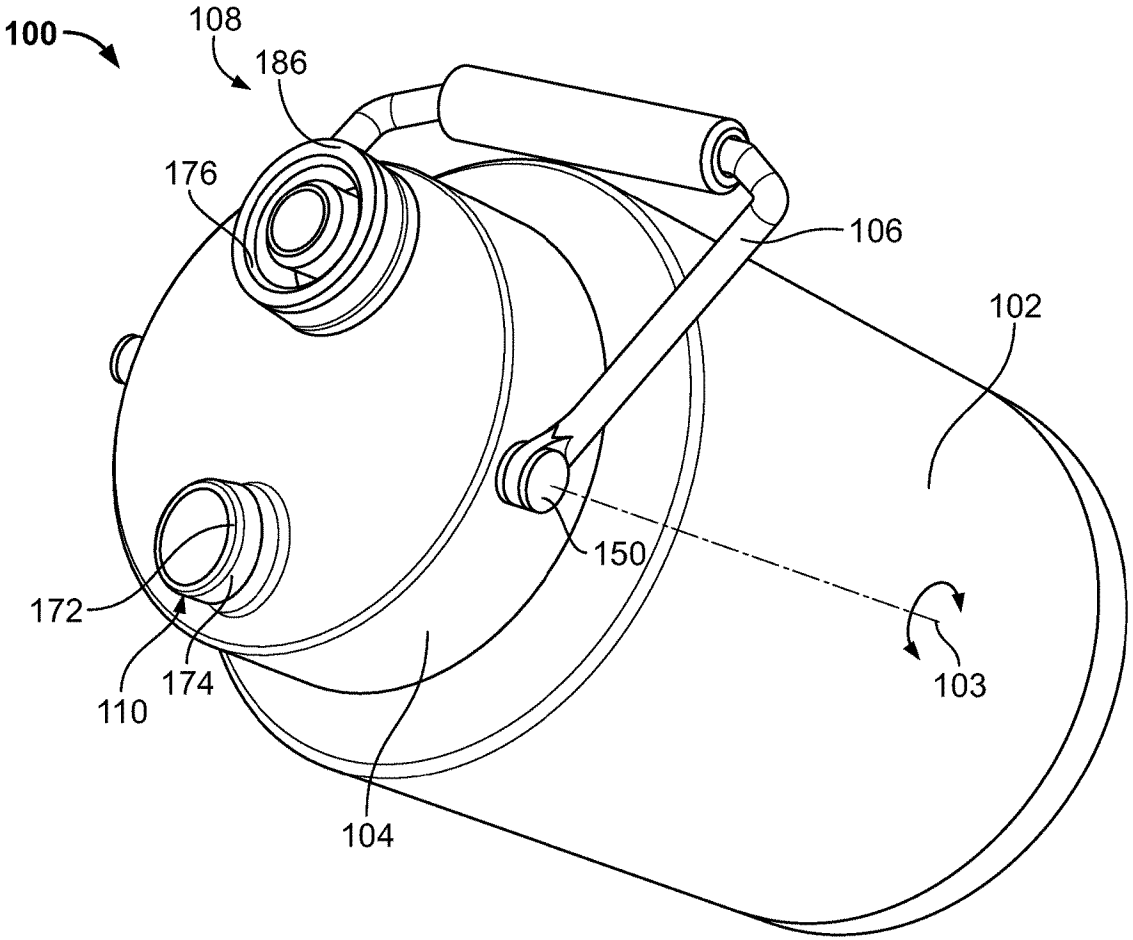
FIG. 2 depicts another isometric view of the container of FIG. 1, according to one or more aspects described herein.

In various examples, the lid 104 may comprise a cap 108 (in one example, cap 108 may be substantially cylindrical), configured to removably couple to, and seal (i.e. resealably seal), a spout opening 110, as depicted in FIG. 2. In one implementation, the carry handle structure 106 may be rotatably coupled to the lid 104, such that the carry handle structure 106 may be pivoted from a first position, as depicted in FIG. 1, to a plurality of second positions, wherein one second position, from the plurality of second positions, is depicted in FIG. 2. For example, the carry handle structure 106 may be rotatable about an axis 103 through a fastener 150 that couples the carry handle structure 106 to the lid 104 (see FIG. 2). In one implementation, the carry handle structure 106 may be rotatable about axis 103 through an angle of greater than 320°. In another example, the carry handle structure 106 may be rotatable about axis 103 through an angle of greater than 300°, greater than 280°, greater than 260°, greater than 240°, or greater than 220°, among others.

In one example, the canister 102 may be configured to store a volume of liquid. In one implementation, the canister 102 may be configured to store approximately 1 gallon (approximately 3.79 L) of a liquid. In another implementation, the canister 102 may be configured to store at least approximately 30 ounces (approximately 0.89 L), at least approximately 50 ounces (approximately 1.48 L), at least approximately 70 ounces (approximately 2.07 L), at least approximately 80 ounces (approximately 2.37 L), at least approximately 90 ounces (approximately 2.66 L), at least approximately 100 ounces (approximately 2.96 L), at least approximately 110 ounces (approximately 3.25 L), or at least approximately 120 ounces (approximately 3.55 L) of a liquid, among others.

Figure 5:
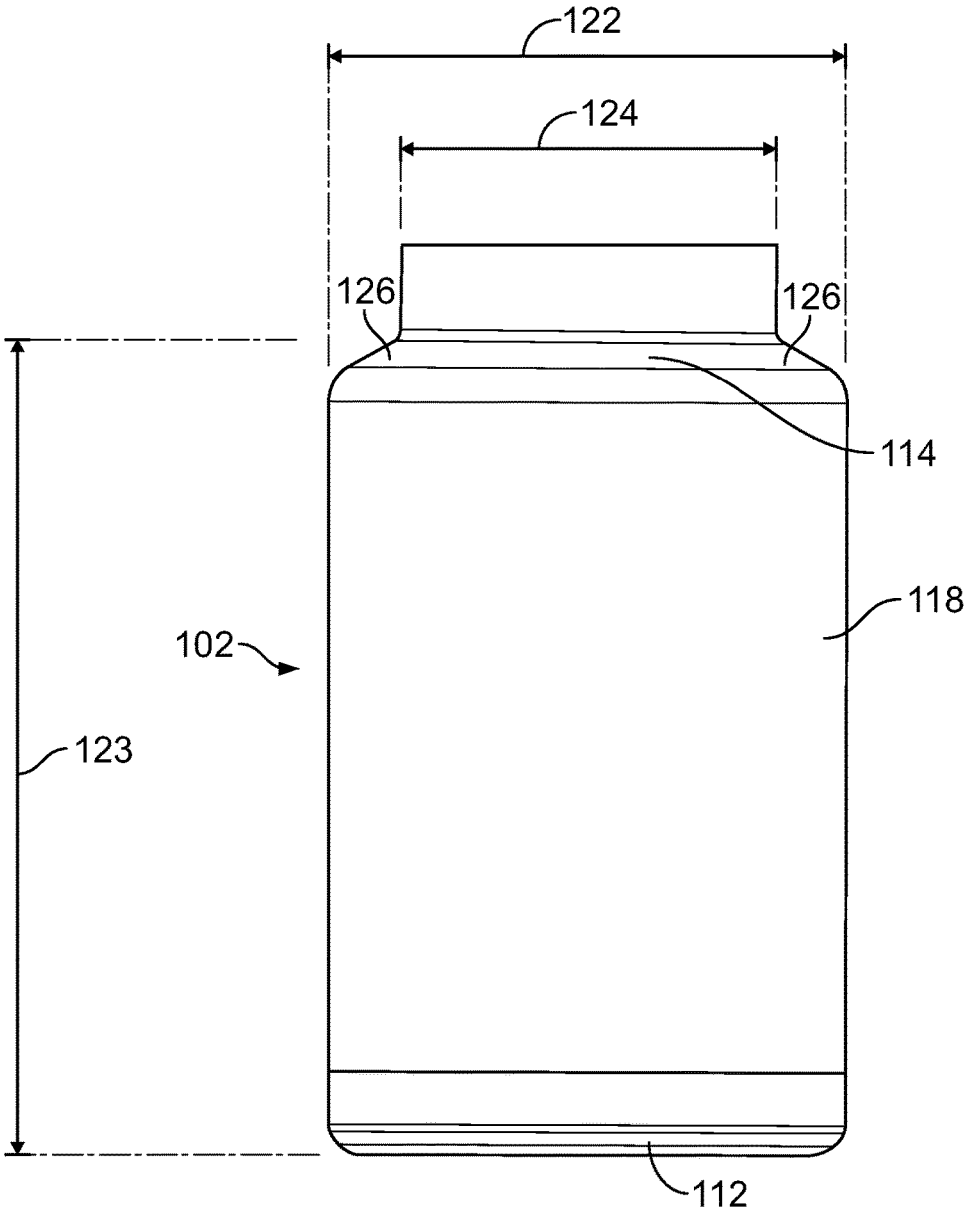
FIG. 5 depicts a side view of a canister, according to one or more aspects described herein.

Turning briefly to FIG. 5, the canister 102 may have an outer diameter 122, and a height 123. In one implementation, the outer diameter 122 may measure approximately 6.5 inches (165.1 mm). In another implementation, the outer diameter 122 may measure approximately 5.7 inches (145 mm). In yet another implementation, the outer diameter 122 may range between 5 inches and 8 inches. In one example, the height 123 may measure approximately 9.7 inches (246.4 mm). In another implementation, the height 123 may measure approximately 7.4 inches (188 mm). In yet another implementation, the height 123 may range between 7 and 11 inches. However, in other implementations, the canister 102 may be embodied with different dimensional values for the outer diameter 122 and the height 123, without departing from the scope of this disclosure. Additionally, the canister 102 may maintain a same aspect ratio between the outer diameter 122 and the height 123 as that depicted in, for example, FIG. 5. However, in another implementation, the canister 102 may be embodied with dimensions such that a different aspect ratio between the outer diameter 122 and the height 123 to that depicted FIG. 5 may be utilized. In yet another implementation, canister 102 may be configured with any external or internal dimensions, and such that the canister 102 may be configured to store any volume of liquid, without departing from the scope of the disclosure described herein. Additionally or alternatively, the container 100 may be configured to store materials in a liquid, a solid, or a gaseous state, or combinations thereof, without departing from the scope of the disclosure described herein.

Turning again to FIG. 1, in various examples, the canister 102 may comprise a first end 112 forming a base configured to support the canister 102 on an external surface. In one example, for the implementation of container 100 having a substantially cylindrical bottom portion 102 (canister 102), the first end 112 may have a substantially circular shape. The canister 102 may comprise a second end 114 having an opening 116 therein, as depicted in FIG. 3. Further, the first end 112 and the second end 114 may be separated by a curved sidewall 118 forming a substantially cylindrical shape of the canister 102. In one implementation, the opening 116 may be configured to allow a liquid to be introduced into, or removed from the canister 102. In another example, when the lid 104 is coupled to the canister 102, the opening 116 may be configured to allow a liquid stored in the canister 102 to flow into the lid 104 and out through the spout 110.

In one example, the spout opening 110 may be configured with an annular ridge 172. As such, the cap 108 may be configured to be removably-coupled to the spout 110 using an interference fit between the annular ridge 172 on a cylindrical outer wall 174 of the spout opening 110, and a corresponding ridge (not pictured in FIG. 1 or FIG. 2) on an inner surface 176 of the cap 108, as depicted in FIG. 2.

FIG. 3 depicts an exploded isometric view of another example container 300, according to one or more alternative aspects described herein. In one implementation, container 300 may be similar to container 100 from FIG. 1 and FIG. 2, where similar reference numerals represent similar features. In one example, container 300 may also comprise a lid 104 having a spout opening 310. However, the spout opening 310 may include a threaded outer wall 168 for receiving a correspondingly threaded inner wall of the cap 308. Specifically, as shown in FIGS. 3 and 4, the depicted cap 308 may be similar to the cap 108, but instead of utilizing an interference fit, the cap 308 may comprise a threaded inner wall 170 configured to be screwed onto a threaded cylindrical outer wall 168 of the spout opening 310.

In one example, the lid 104 may have a substantially cylindrical shape. In one implementation, the lid 104 may be configured to removably couple to a neck structure 120 of the canister 102. As such, the neck structure 120 may encircle the opening 116 in the canister 102, and extend out from the canister 102 in a substantially axial direction. In one implementation, an axial direction 302 associated with canister 102 may be parallel to an axis of rotation of a substantially cylindrical structure of canister 102, as depicted in FIG. 3. In one implementation, a radial direction 304 may be perpendicular to the axial direction 302. In various examples, lid 104 may have an opening 111 configured to receive the neck structure 120. Further details of a removable coupling between the lid 104 and the neck structure 120 are discussed in relation to FIG. 4.

In various examples, the canister 102 may be embodied with different geometries. For example, container 100 or container 300 may be embodied with a base portion, similar to canister 102, having a non-cylindrical shape. In particular, container 100 or container 300 may have a base, similar to canister 102, having a substantially cuboidal, spherical, or prismoidal shape, or combinations thereof, among others, without departing from the scope of the disclosures described herein. As such, container 100 or container 300 may have a base portion, similar to canister 102, having a non-cylindrical shape, but maintaining a substantially cylindrical neck structure 120, configured to be removably coupled to a substantially cylindrical lid 104. In yet another implementation, an opening, similar to opening 116, and a neck structure, similar to neck structure 120, may have non-circular geometries, without departing from the scope of the disclosures described herein. Additionally or alternatively, a lid of container 100 or container 300, similar to lid 104, may have a non-circular shape, without departing from the scope of the disclosures described herein. For example, a lid of container 100 or container 300, similar to lid 104, may have a substantially cuboidal, spherical, or prismoidal shape, or combinations thereof, among others, without departing from the scope of the disclosures described herein.

Figure 4:
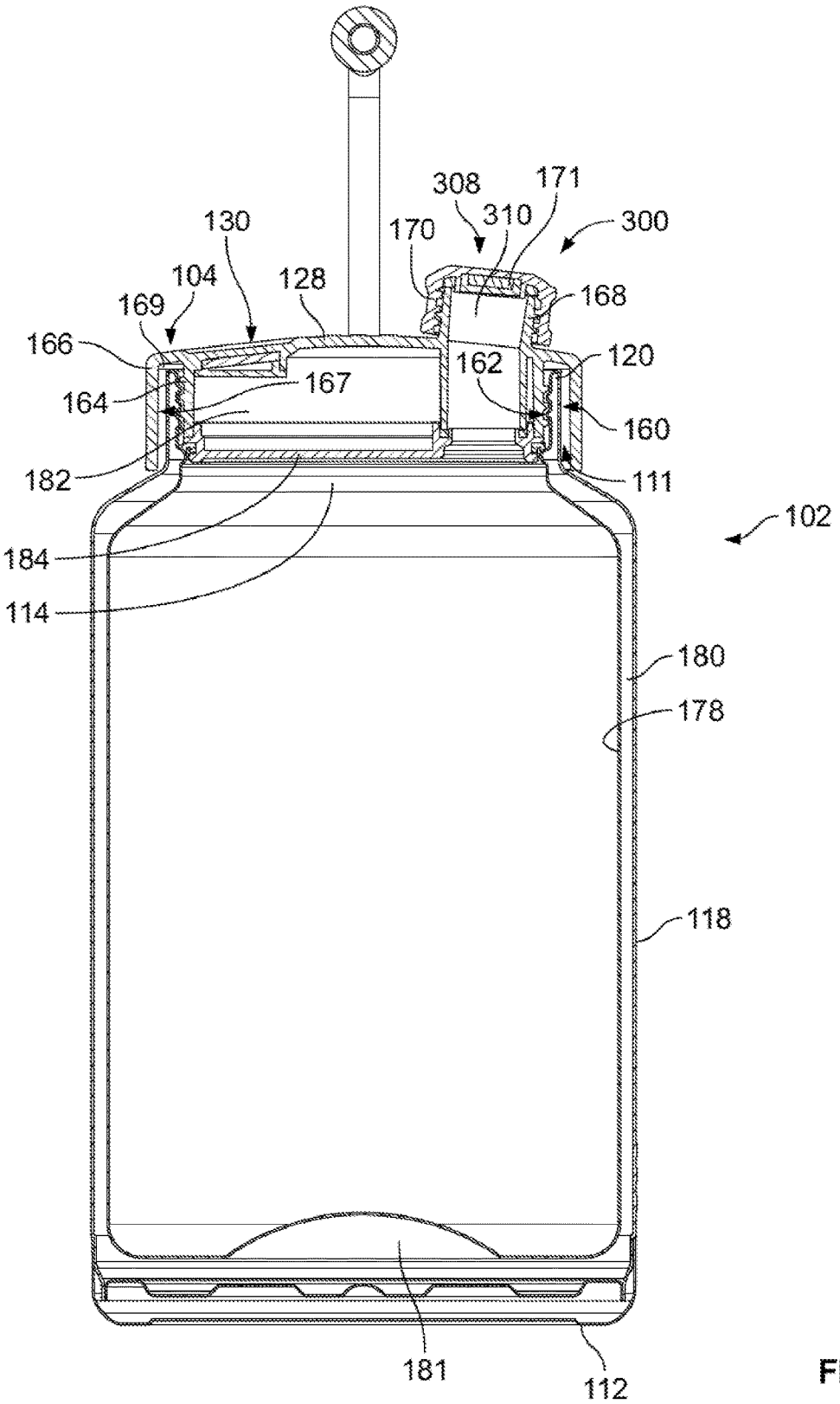
FIG. 4 depicts a cross-sectional sectional view of the container of FIG. 3, according to one or more aspects described herein.

FIG. 4 depicts a cross-sectional view of one implementation of the container 300. In one example, the lid 104 may be removably coupled to the canister 102 using a threaded fastening mechanism. Accordingly, in one implementation, the neck structure 120 may have a smooth outer surface 160 and a threaded inner surface 162. In this way, the threaded inner surface 162 may be configured to interface with a threaded inner wall 164 of the lid 104. As such, when coupled to the canister 102, an outer wall 166 of the lid 104 may cover the neck structure 120.

Additional or alternative coupling mechanisms may be utilized to removably couple the lid 104 to the canister 102, without departing from the scope of the disclosures described herein. For example, the neck structure 120 may be embodied with a threaded outer surface (e.g. outer surface 320 may be threaded) and configured to interface with a corresponding threaded structure on the lid 104. In one example, this additional or alternative threaded structure on the lid 104 may be on an inside surface of the outer wall 166 (e.g. threads may be formed on inside surface 167 of the outer wall 166), among others.

In one example, a connection mechanism configured to removably couple the lid 104 to the canister 102 may be designed such that the coupling is fully engaged upon rotation of the lid 104 relative to the canister 102 by any number of revolutions, or by any fraction of a revolution. For example, the lid 104 may be fully engaged with the canister 102 upon placing the lid 104 on the neck structure 120, and rotating the lid 104 by approximately ¼ of one full revolution, approximately ⅓ of one full revolution, approximately ½ of one full revolution, approximately 1 full revolution, approximately 2 full revolutions, approximately 3 full revolutions, at least 1 revolution, or at least five revolutions, among many others.

In one implementation, a removable coupling between the lid 104 and the canister 102 may comprise one or more gaskets (e.g. gasket 169) configured to seal the coupling such that, in one example, liquid may not escape from the canister 102 while the removable coupling between the lid 104 and the canister 102 is engaged.

In one example the cap 308 may be fully engaged with the threaded fastening mechanism of the spout 310 by rotating the cap 308 relative to the spout 310 through an angle. For example, the cap 308 may be fully engaged with the spout 310 by rotating the cap 308 by approximately ¼ of one full revolution, approximately ⅓ of one full revolution, approximately ½ of one full revolution, approximately 1 full revolution, approximately 2 full revolutions, approximately 3 full revolutions, at least one revolution, or at least five revolutions, among many others.

In one implementation cap 108 (or cap 308) may seal the spout opening 110 (or spout opening 310) using one or more deformable gaskets structures that are compressed when the cap 108 (or cap 308) is brought into a removable coupling with the spout opening 110 (or spout opening 310). In one example, element 171 may be a gasket between the spout opening 310 and the cap 308.

In one implementation, containers 100 and 300 may include one or more insulating elements configured to reduce a rate of heat transfer to or from a material stored within the container. In one example, the canister 102 may be configured with a vacuum-sealed insulating structure, otherwise referred to as a vacuum-sealed double wall structure, or an insulated double wall structure, and such that a vacuum is maintained between an inner wall 178 and an outer wall 118 of the canister 102. In one implementation, a sealed vacuum cavity 180 may be sandwiched between the inner wall 178 and the outer wall 118. In other examples, specific implementations of insulating structures that utilize one or more vacuum chambers to reduce heat transfer by conduction, convection and/or radiation may be utilized within canister 102, without departing from the disclosures described herein. In another implementation, containers 100 and 300 may include an insulated double wall comprising an inner wall 178 and an outer wall 118. In one example, a cavity 180 between the inner wall 178 and the outer wall 118 may be filled with air to form an air pocket. In another example, the cavity 180 may be filled with an insulating material, such as an insulating foam (e.g. polystyrene).

In one example, the combination of the inner wall 178 and the outer wall 118 may be referred to as an insulated wall. In one implementation, the first end 112, the second end 114, the curved sidewall 118, and/or a shoulder region 126 (described in further detail in relation to FIG. 5) may comprise a vacuum-sealed insulated wall between the inner wall 178 and the outer wall 118. Further, an inner surface of one or more of the inner wall 178 or the outer wall 118 may comprise a silvered surface configured to reduce heat transfer by radiation.

In one implementation, canister 102 may comprise a concave structure 181 formed in the first end 112. In one example, the concave structure 181 may provide added rigidity to the first end 112, and such that the concave structure 181 reduces, or prevents, deformation of the first end 112 as a result of a vacuum within the vacuum cavity 180. Accordingly, the concave structure 181 may have any radius or multiple radii of curvature (i.e. the concave structure 181 may comprise a geometry having multiple radii of curvature), without departing from the scope of these disclosures.

In another implementation, the cavity 180 may be filled with an insulating material that exhibits low thermal conductivity. As such, the cavity 180 may, in one example, be filled with a polymer material, or a polymer foam material. In one specific example, the cavity 180 may be filled with polystyrene. However, additional or alternative insulating materials may be utilized to fill the cavity 180, without departing from the scope of these disclosures. In one example, a thickness of the cavity 180 may be embodied with any dimensional value, without departing from the scope of these disclosures.

In one example, the canister 102 may be constructed from one or more metals, alloys, polymers, ceramics, or fiber-reinforced materials. Additionally, canister 102 may be constructed using one or more hot or cold working processes (e.g. stamping, casting, molding, drilling, grinding, forging, among others). In one implementation, the canister 102 may be constructed using a stainless steel. In one specific example, the canister 102 may be formed substantially of 304 stainless steel. In one implementation, one or more cold working processes utilized to form the geometry of the canister 102 may result in the canister 102 being magnetic (may be attracted to a magnet).

In one example, and as depicted in FIG. 4, the lid 104 may be embodied with a cavity 182. As such, this cavity 182 may be formed between the top surface 128 and a bottom surface 184. In this way, the cavity 182 may provide further insulation to the container 300 by containing one or more of an air pocket, a vacuum-sealed cavity, or by containing a mass of an insulating material, among others. In one specific example, the cavity 182 may be filled with a polymer foam, such as polystyrene. However, additional or alternative insulating materials may be utilized to fill the cavity 182, without departing from the scope of these disclosures.

FIG. 5 depicts an end view of canister 102, which may be used with container 100 or container 300. Accordingly, canister 102 may have a first outer diameter 122 at the first end 112 and a second outer diameter 124 at the opening 116 of the canister 102. In one example, the second diameter 124 may be less than the first diameter 122, such that an outer diameter of the substantially cylindrical sidewall 118 tapers from the first outer diameter 122 to the second outer diameter 124 along a shoulder region 126. In one example, the shoulder region 126 may improve heat transfer performance of the canister 102 (reduce a rate of heat transfer) when compared to a container having a constant outer diameter between a first end, similar to first end 112, and a second end, similar to the second and 114. In particular, the first end 112, the curved sidewall 118 (otherwise referred to as the outer wall 118), and the shoulder region 126 may comprise insulation having lower thermal conductivity (higher thermal resistance/insulation) than the lid 104 that seals the opening 116. As such, a configuration of container 100 or container 300 having opening 116 with a smaller second diameter 124 than the first diameter 122 provides for an increased surface area having the comparatively higher performance insulation (lower thermal conductivity insulation).

In another implementation, having the second outer diameter 124 less than the first outer diameter 122 may increase the structural rigidity of the canister 102 at the second end 114, and such that the opening 116 may be less prone to undesirable warping/bending during one or more processes used to form the structure of the canister 102.

In another example, the container 100 should not be limited to having a first diameter 122 greater than a second diameter 124 such that an outer diameter of the substantially cylindrical sidewall 118 tapers from said first outer diameter 122 to said second outer diameter 124 along a shoulder region 126. As such, the canister 102 may have a substantially constant outer diameter (not pictured), and such that an opening, similar to opening 116, may have a diameter approximately equal to an outer diameter of a first end of the base, similar to the first end 112.

Figure 6:
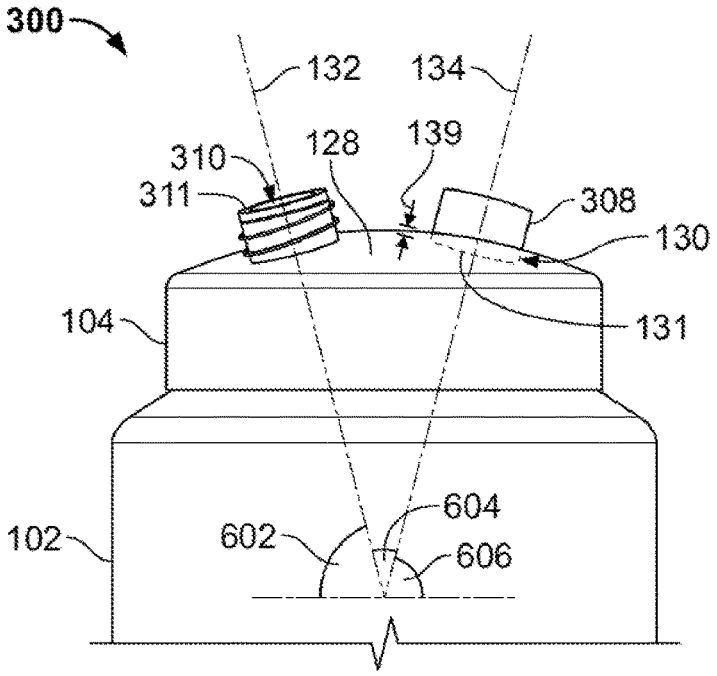
FIG. 6 schematically depicts an end view of the container of FIG. 3, according to one or more aspects described herein.

FIG. 6 schematically depicts an end view of container 300. In one implementation, the lid 104 may be configured with a circular domed (convex) top surface 128. In one implementation, the cap 308, when removed from the spout opening 310, may be positioned within a dimple 130, otherwise referred to as a recess structure 130 (depicted in the plan view of container 300 of FIG. 7). In one implementation, when positioned within the dimple 130, the cap 308 may be angled away from the spout 310, as schematically depicted in FIG. 6.

Additionally, FIG. 6 depicts the cap 308 removed from the spout 310 and positioned within the dimple 130. The spout 310 may have a central axis 132 corresponding to (parallel to) an axis of rotation associated with a substantially cylindrical structure of the spout opening 310. The central axis 132 may be perpendicular to an annular ridge 311 of the spout opening 310, similar to annular ridge 172 of the spout opening 110 from FIG. 2. In various examples, the dimple 130 may have a central axis 134 corresponding to (parallel to) an axis of rotation associated with a substantially circular structure of the dimple 130. The central axis 134 may be perpendicular to a planar surface 131 of the dimple 130.

In various examples, the spout 310 extends from the substantially convex geometry of the circular domed top surface 128 and has a central axis 132 which extends along a normal 132 relative to the domed top surface 128. The dimple 130 also includes a central axis 134 (which may be parallel to a central axis of cap 308, when positioned within dimple 130) and extends substantially along a normal 134 relative to the domed top surface 128, such that the spout 310 and the cap 308 may angled away from one another. Advantageously, and in various examples, this relative positioning of the spout 310 and the cap 308 may allow for improved separation, such that the cap 308 is not contacted when a user is drinking from/pouring from the spout 310.

In one implementation, an angle between central axis 132 (otherwise referred to as normal 132) and central axis 134 (otherwise referred to as normal 134) is schematically depicted as angle 604. As such, angle 604 may be referred to as an intersection angle 604 between a central axis 132 of the spout 310 and a central axis 134 of the dimple 130. As such, angle 604 may be greater than approximately: 2°, 5°, 10°, 15°, 20°, 30°, 45°, 55°, 60°, 70°, 80°, 90°, 100°, or 110°, among others. In another implementation, angle 604 may range from 2 to 110 degrees, among others. Angle 602 schematically represents an angle between central axis 132 (normal 132) and a base surface of the container 300 (e.g. first end 112). In one example, angle 602 may be referred to as a tilt angle 602 between the central access 132 and a base surface of the container 300 (e.g. first end 112, or any plane parallel thereto). In this way, tilt angle 602 may be an angle of less than 90°. As such, in various examples angle 602 may be less than approximately: 90°, 85°, 80°, 70°, 60°, 45°, or 30°, 60°, 45°, or 30°, among others. In another implementation, angle 602 may range from 30 to 90 degrees, among others. Similar to angle 602, angle 606 schematically represents an angle between central axis 134 (normal 134) and a base surface of the container 300 (e.g. first end 112, or any plane parallel thereto). As such, angle 606 may be referred to as tilt angle 606. In this way, tilt angle 606 may be an angle of less than 90°. In various examples, angle 606 may be less than approximately: 90°, 85°, 80°, 70°, 60°, 45°, or 30°, among others. In one implementation, angle 606 may range from 30 to 90 degrees, among others. In one example, angle 602 may be approximately equal to angle 606. However, in other examples, angle 602 may not be equal to 606.

In one implementation, the circular domed top surface 128 may have a radius of curvature equal to approximately 13.5 inches (342 mm). However, in other implementations, any radius of curvature may be utilized to form the convex geometry of the circular domed top surface 128, without departing from the scope of these disclosures. Additionally or alternatively, the circular domed top surface 128 may comprise multiple radii of curvature, without departing from the scope of this disclosure.

In another implementation, the lid 104 may be configured with other top surface geometries than that circular domed top surface 128 depicted in FIG. 6. For example, lid 104 may have a substantially planar, or a substantially concave top surface, among others (not pictured). Furthermore, one or more of axes 132 and 134 may, in other implementations, not be normal to the circular domed top surface 128. In yet another implementation, axes 132 and 134 may be parallel to one another.

Figure 7:
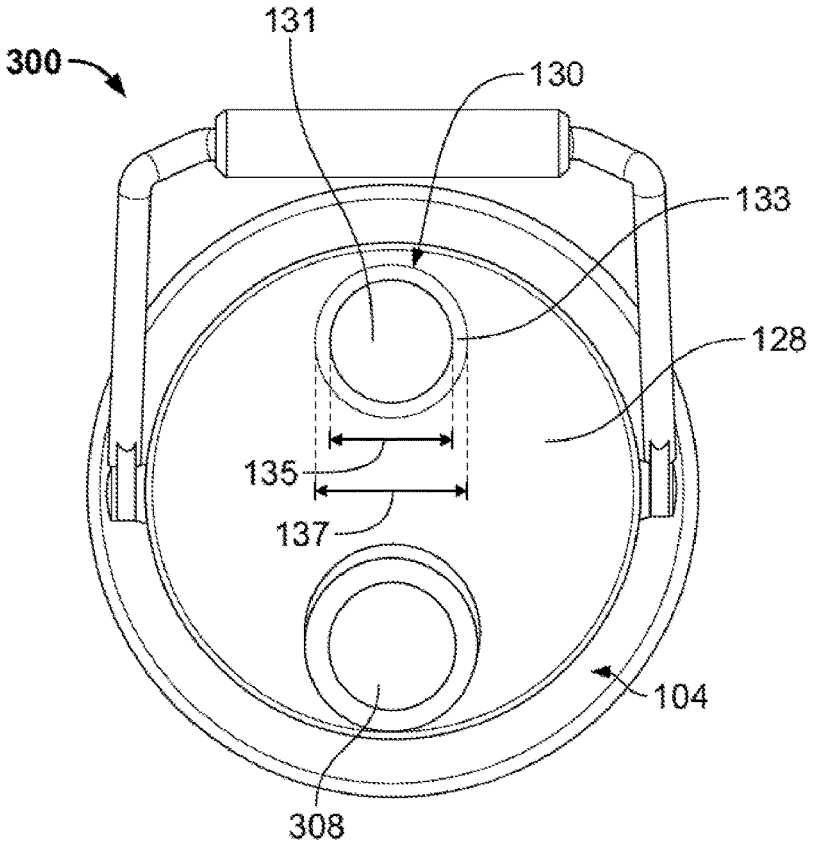
FIG. 7 schematically depicts a plan view of the container of FIG. 3, according to one or more aspects described herein.

FIG. 7 schematically depicts a plan view of the container 300. In one implementation, the dimple 130 may have a substantially circular geometry. In particular, the dimple 130 may have a concave geometry. Accordingly, a concave geometry of dimple 130 may be embodied with any radius of curvature, without departing from the scope of these disclosures. In another example, the dimple 130 may have a flat bottom (i.e. substantially planar) surface 131 connected to the circular domed top surface 128 by a sidewall 133. In one example, the sidewall 133 may be straight, chamfered, or filleted. As such, in one implementation, the dimple 130 may have an inner diameter 135, an outer diameter 137, and a depth 139 (see FIG. 6). For that implementation of dimple 130 having a straight sidewall 133 between surface 131 and surface 128, the inner diameter 135 may be approximately equal to the outer diameter 137.

In one specific example, the inner diameter 135 may measure approximately 25.5 mm, and the outer diameter 137 may measure approximately 29.4 mm. In another example, the inner diameter 135 may measure up to approximately 28 mm, and the outer diameter 137 may measure up to approximately 30 mm. In other examples, the inner diameter 135 and the outer diameter 137 may be embodied with any dimensions, without departing from the scope of these disclosures. In one implementation, the depth 139 of the dimple 130 may range from 1 mm or less to 5 mm or more. However, the depth 139 may be embodied with any value, without departing from the scope of this disclosure. Further, the sidewall 133, if chamfered, may be angled at any angular value between the surface 131 and the surface 128. Similarly, the sidewall 133, if filleted, may have any radius of curvature between the surface 131 and the surface 128.

In one implementation, the magnetic surface 131 may comprise a polymer outer layer over a ferromagnetic structure (i.e. a metal plate may be positioned below magnetic surface 131 in order for the magnetic surface 131 to attract a magnet embedded within a magnetic top surface 136 of the cap 308 (see FIG. 8). In another implementation, the magnetic surface 131 may comprise a polymer overmolded over a magnet structure (i.e. a magnet may be positioned within the lid 104 as it is being molded.

The term "magnetic," as utilized herein, may refer to a material (e.g. a ferromagnetic material) that may be magnetized. As such, the term "magnetic" may imply that a material (i.e. a surface, or object, and the like) may be magnetically attracted to a magnet (i.e. a temporary or permanent magnet) that has an associated magnetic field. In one example, a magnetic material may be magnetized (i.e. may form a permanent magnet). Additionally, various examples of magnetic materials may be utilized with the disclosures described herein, including nickel, iron, and cobalt, and alloys thereof, among others.

Figure 8:
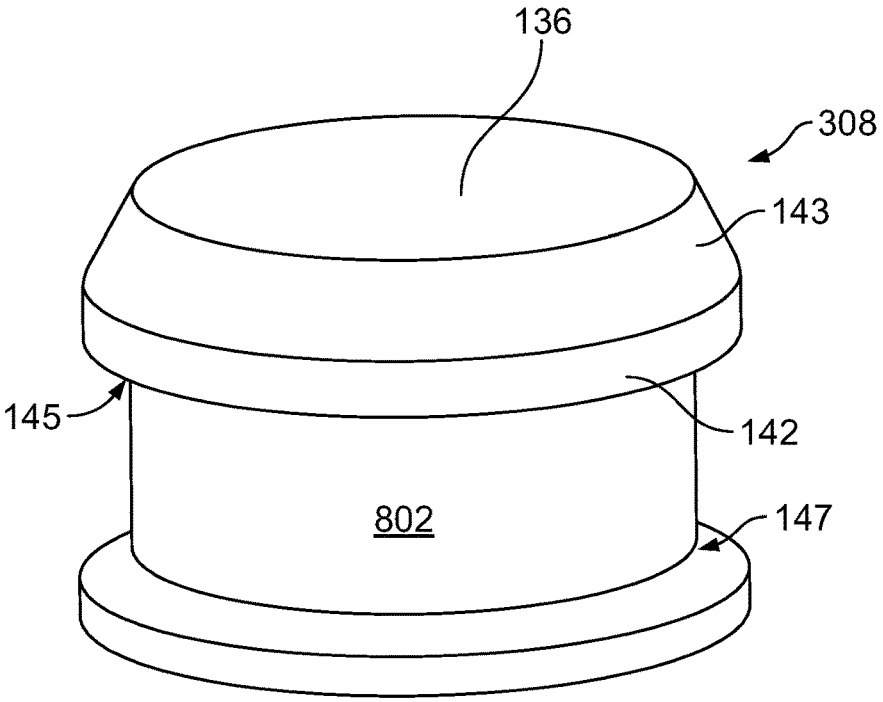
FIG. 8 depicts an example cap structure, according to one or more aspects described herein.

FIG. 8 depicts a more detailed view of the cap 308. In particular, cap 308 may be configured with a substantially cylindrical geometry. In one implementation, the cap 308 may comprise a magnetic top surface 136. As such, the cap 308 may be configured to removably couple to, and seal, the spout 310. Further, upon manual removal of the cap 308 from the spout 310, the magnetic top surface 136 may be configured to magnetically couple to a magnetic surface 131 of the dimple 130, as depicted in FIG. 7. As such, the dimple 130 may comprise a magnetic material to which the magnetic top surface 136 may be magnetically attracted.

In one example, the cap 308 may be constructed from a polymer material, and formed using one or more injection molding processes. As such, the magnetic top surface 136 may comprise an overmolded permanent magnet. Various permanent magnet materials may be utilized with the magnetic top surface 136 of cap 308, without departing from the scope of the disclosures described herein. In one particular example, the magnetic top surface 136 may comprise a neodymium magnet of grade N30, among others. Furthermore, various overmolding methodologies may be utilized to encapsulate a magnet within the cap 308, without departing from the scope of the disclosures described herein. In another example, the cap 308 may comprises a permanent magnet coupled below the polymeric magnetic top surface 136 such that the permanent magnet may be ultra-sonically welded, or glued onto a surface within the cap 308 (e.g. magnet 173 may be retained within the cap 308 by structure 175, which may comprise a polymer plate that is ultrasonically welded, glued, or otherwise coupled to the cap 308.

Advantageously, a magnetic coupling between the magnetic top surface 136 of cap 308, and the magnetic surface 131 of dimple 130 may provide for fast, temporary storage of cap 308 while a liquid is being poured from container 300. In this way, a user may quickly affix cap 308 into dimple 130 such that cap 308 may not be set aside on an external surface where it may be misplaced or contaminated. Further advantageously, a magnetic coupling between the magnetic top surface 136 of the cap 308 and a magnetic surface 131 of the dimple 130 may encourage surfaces 136 and 131 to contact one another such that a bottom surface of cap 308 (e.g. bottom surface 186 of cap 108, which may be similar to 308) does not contact the magnetic surface 131 of the dimple 130. In this way one or more surfaces, including the bottom surface 186, of cap 108 or 308 may be exposed to fewer contaminants, and thereby reduce transmission of fewer contaminants to spout 310 upon re-coupling of the cap 308 with the spout 310. It is noted that the previously described advantages with regard to magnetically coupling the cap 308 into the dimple 130 may, additionally or alternatively, be realized with cap 108 from container 100.

In one example, cap 308 may comprise one or more polymer materials. However, cap 308 may comprise one or more of a metal, an alloy, a ceramic, or a wood material or combinations thereof, without departing from the scope of the disclosure described herein.

In one example, cap 308 may have a substantially cylindrical shape with a cylindrical outer wall 802. As such, cap 308 may be embodied with any outer diameter for the outer wall 802, without departing from the scope of this disclosure. In one example, cap 308 may have a surface 143 extending between the magnetic top surface 136 and a side surface 142. In one implementation, the surface 143 may form a chamfer between the top surface 136 and the side surface 142. As such, surface 143 may be embodied with any chamfer angle between the top surface 136 and the side surface 142. In another implementation, surface 143 may form a fillet between the top surface 136 on the side surface 142. As such, an example filleted surface 143 may be embodied with any desired fillet angle or radius. In one implementation, surface 143 may be utilized to center the cap 308 within the dimple 130. In one implementation, a fillet radius of surface 143 may be approximately equal to a fillet radius of surface (sidewall) 133 of the dimple 130. Similarly, and in another implementation, a chamfer angle of surface 143 may be approximately equal to a chamfer angle of surface (sidewall) 133 of dimple 130. In one example, the cap 308 may have lip structures 145 and/or 147 to facilitate manual gripping of the cap 308 to remove upon removal of the cap 308 from the spout 310 or the dimple 130, among others. In another implementation, the cap 308 may be implemented such that outer wall 802 has an outer diameter equal to the outer diameter of surface 142, and such that the cap 308 is not embodied with lip structures 145 and/or 147.

Figure 11:
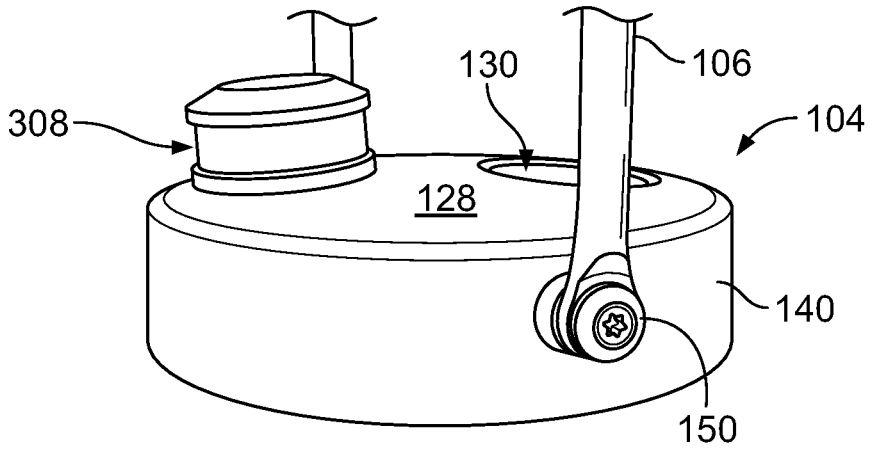
FIG. 11 schematically depicts an isometric view of another example lid structure, according to one or more aspects described herein.

In one example, and as depicted in FIG. 11, the spout 310 (FIG. 11 depicts the cap 308 coupled to the spout 310) may be off-center on the circular domed top surface 128. In particular, the spout 310 may be positioned substantially at a perimeter of the circular domed top surface 128. Further, in one implementation, the recess 130 may be diametrically opposed to the spout opening 310, as depicted FIG. 7. However, the spout opening 310 may be positioned in other locations on the lid 104, without departing from the scope of the disclosure described herein. For example, the spout opening 310 may be positioned substantially at a center of the circular domed top surface 128. In another example, the spout opening 110 may be positioned on a curved sidewall of the lid 104, such as the curved sidewall 140 depicted in FIG. 11. In another example, the recess 130 may not be diametrically opposed to the spout opening 310. As such, in one example, the recess 130 may be positioned substantially at a center of the domed top surface 128, while the spout opening 310 may be positioned substantially at the perimeter of the circular domed top surface 128.

In one implementation, the lid 104, as depicted in FIG. 7, may be constructed from a polymeric material. In one example, the lid 104 may be injection molded. In one implementation, dimple 130 may comprise a ferromagnetic structure, or plate, that is overmolded to form the lid 104. In this way, upon manual removal of the cap 308 from the spout 310, the magnetic top surface 136 of the cap 308 may be magnetically attracted to the dimple structure 130 when positioned within a given proximity of the dimple structure 130. In another example, dimple 130 may comprise a ferromagnetic structure, or plate, that is positioned behind the surface 131 (e.g. glued, or ultra-sonically welded or otherwise attached to an interior side of the lid 104 within the cavity 182).

In one example a force needed to remove the cap 308 from the dimple structure 130 (i.e. a force to overcome a magnetic attraction between the cap 308 and the dimple structure 130) may measure approximately 10 N. In another example, the force to remove cap 308 from the dimple structure 130 may range between approximately 7 and 15 N. In another implementation, magnetic top surface 136 may be magnetically coupled to the curved sidewall 118 of the canister 102. Accordingly, in one example, a force needed to overcome a magnetic attraction between the cap 308 and the curved sidewall 118 may measure approximately 3 N. In another example, the force to remove the cap 308 from the curved sidewall 118 may range between approximately 1 and 10 N.

In another implementation, there may be a specific distance/proximity within which magnetic attraction is exerted between the magnetic top surface 136 of the cap 308, and the ferromagnetic structure of the dimple 130. This proximity may be dependent upon a strength (magnetic field strength, and the like) of the magnet contained within the magnetic top surface 136, among other factors. As such, there may exist a proximity within which the magnetic top surface 136 of the cap 308 may be positioned relative to the dimple structure 130 in order to magnetically couple the two structures may be embodied with any distance value. This proximity may be embodied with any value, without departing from the scope of the disclosures described herein. Accordingly, any strength of magnet may be utilized with the disclosures described herein. Additionally, various ferromagnetic materials may be utilized within the dimple structure 130, without departing from the disclosures described herein.

In another example, a ferromagnetic material may be positioned within the dimple structure 130, and such that that an overmolding process is not utilized to cover the ferromagnetic material. Similarly, a magnet may be positioned on the magnetic top surface 136 of the cap 308, and such that the magnet is exposed, rather than being overmolded or covered.

In various examples, the container 300 may be configured such that the magnetic top surface 136 of the cap 308 is configured to magnetically couple only within the recess 130. As such, the remainder of container 300 may be constructed using one or more non-magnetic materials. In another example, a magnetic top surface 136 of the cap 308 may be configured to magnetically couple to one of a plurality of locations on the lid 104. In particular, in one example, the circular domed top surface 128 of the lid 104 may comprise a plurality of overmolded ferromagnetic pieces configured to magnetically couple to the magnetic top surface 136 of the cap 308. In another example, the lid 104 may be constructed using, or coated with, a metallic material that may be attracted to a magnetic field.

In various examples, container 300 may be configured such that the magnetic top surface 136 of the cap 308 may be configured to magnetically couple to the spout 310 (i.e. spout 310 may be embodied with one or more ferromagnetic materials). Accordingly, the opening into the canister 102 through the spout opening 310 may be sealed by magnetic attraction of the cap 308 to the spout opening 310.

In various examples, cap 308 may be attached within dimple 130 using another coupling mechanism in addition to, or as an alternative to, the magnetic metric coupling between the magnetic top surface 136 and surface 131. For example, the top surface 136 and surface 131 may be embodied with complementary threaded coupling elements, interference fit coupling elements (i.e. snap coupling), or hook and loop coupling elements, among others.

Additionally or alternatively, the canister 102 may comprise a magnetic material, such that the magnetic top surface 136 may be magnetically coupled to a surface (e.g. the curved sidewall 118) of the canister 102. In one particular example, the canister 102 may comprise a stainless steel material (e.g. 304 stainless steel), and may be magnetized by a one or more cold working processes used to form the various geometries of the canister 102. However, the canister 102, and indeed any of the structures of container 300 described herein, may be constructed using one or more of a metal, an alloy, a polymer, a ceramic, a wood material, or combinations thereof.

In various examples, the recess 130 may comprise an overmolded, or otherwise covered, permanent magnet, and the magnetic top surface 136 of the cap 308 may comprise an overmolded ferromagnetic material (e.g. iron). In yet another example, both of the magnetic top surface 136 and the recess structure 130 may comprise overmolded, or otherwise covered, permanent magnets configured to attract one another, and the like.

Figure 9:
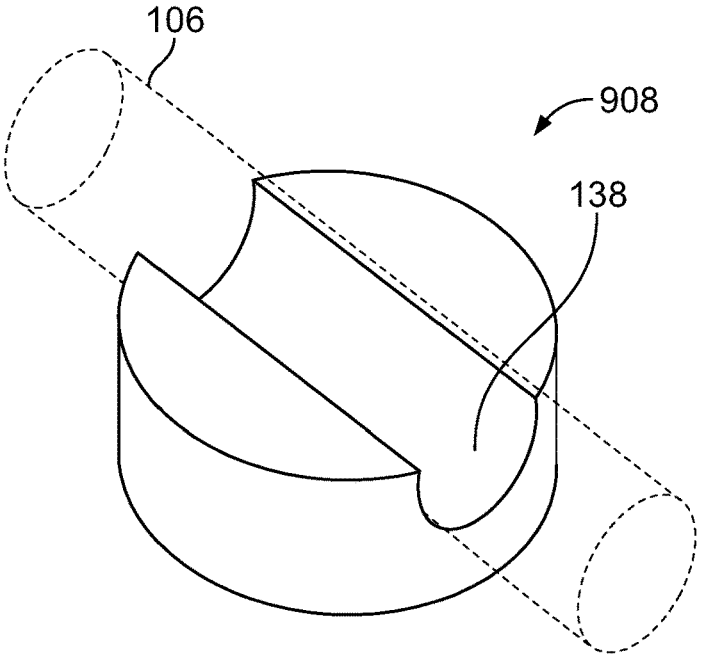
FIG. 9 depicts another example cap structure, according to one or more aspects described herein.

In one example, the cap 308 may comprise a substantially planar magnetic top surface 136. In this way, the substantially planar magnetic top surface 136 may be configured to interface with a substantially planar surface of the recess 130. In another example, a cap 308 may be configured with different geometries. For example, the cap 308 may comprise a curved top surface 136. In another example, FIG. 9 depicts a cap 908 having a magnetic channel structure 138 (rounded surface 138) configured to allow the cap 908 to be magnetically coupled to a curved surface. In one implementation, the magnetic channel structure 138 may be configured to magnetically couple to one or more curved surfaces of the carry handle structure 106. In this way, the carry handle structure 106 may be configured with one or more magnetic materials (overmolded, covered, or exposed magnetic materials). In one implementation, one or more portions of the carry handle structure 106 may comprise a magnet and such that one or more portions of the carry handle structure 106 may be magnetically attracted to, and held in position when brought into contact with, sidewall 118. In yet another example, the magnetic channel structure 138 may have a concave geometry configured to conform to a curved surface geometry of a curved sidewall 118 of the canister 102. As such, the magnetic channel structure 138 may comprise one or more overmolded, or otherwise covered, permanent magnet structures, similar to the magnetic top surface 136 of cap 308 depicted in FIG. 8.

Figure 10:
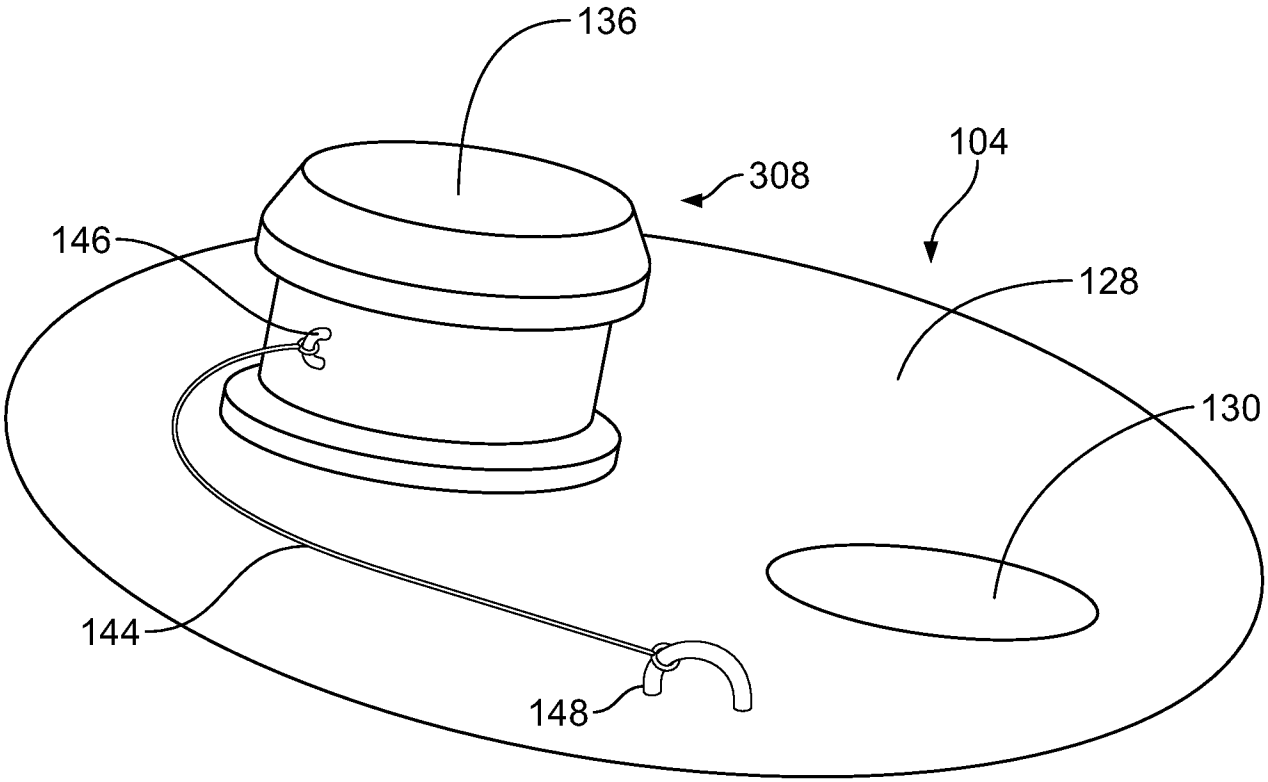
FIG. 10 schematically depicts an isometric view of an example lid structure, according to one or more aspects described herein.

In one implementation, the cap 308 may be embodied with additional or alternative features. For example, and as depicted in FIG. 10, the cap 308 may be embodied with a tether 144 connected between a first anchor point 146 on the cap 308 and a second anchor point 148 on the lid 104. The first anchor point 146 and the second anchor point 148 can be in the form of U-shaped connectors that are either separately fastened or integrally molded. Advantageously, the tether 144 may be utilized to prevent separation of the cap 108 and the lid 104, and may be utilized in combination with a magnetic coupling between a magnetic top surface 136 and a recess 130, such that the magnetic coupling prevents the cap 108 from falling into a stream of liquid being poured from the spout 310, among others. As such, the tether 144 may comprise any flexible material, such as a polymer, a metal, or an alloy, among others, and may be embodied with any length. Similarly, the first anchor point 146 and the second anchor point 148 may be positioned at different locations on the cap 308 and the lid 104, respectively, without departing from the scope of the disclosures described herein.

FIG. 11 depicts a more detailed view of a hinged coupling between the carry handle structure 106 and the lid 104. In particular, a rotatable coupling between the carry handle structure 106 and the lid 104 may be facilitated by fastener 150. In one implementation, fastener 150 may act as a bearing about which the carry handle structure 106 may rotate relative to the lid 104. In one implementation, fastener 150 may comprise a screw configured to be received into a recess in the curved sidewall 140 of the lid 104. However, additional or alternative fastening mechanisms that may be utilized to hingedly couple the carry handle structure 106 to the lid 104, without departing from the scope of the disclosures described herein.

Figure 12:
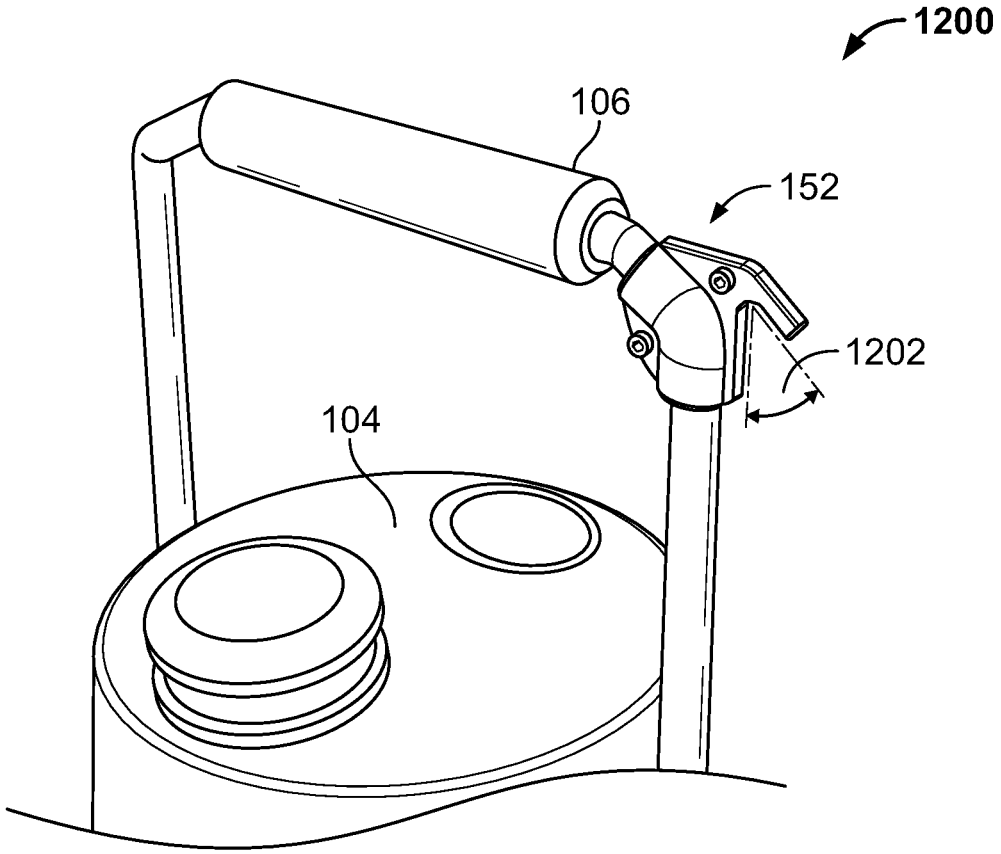
FIG. 12 depicts an isometric view of another example container structure, according to one or more aspects described herein.

FIG. 12 depicts an implementation of a container 1200. Accordingly, container 1200 may be similar to containers 100 and 300, and may, additionally, be embodied with a hook structure 152 rigidly coupled to the carry handle structure 106. As such, the hook structure 152 may be configured to allow the container to be hung from an external structure (e.g. a chain-link fence, similar to fence 156 from FIG. 13, among many others). As depicted in FIG. 12, the hook structure 152 may be positioned at one side of the carry handle structure 106. However, alternative configurations for the hook structure 152 may be utilized without departing from the scope of the disclosures described herein. For example, container 1200 may be embodied with two or more hook structures (e.g. one hook structure to either side of the carry handle structure 106).

In one implementation, the hook structure 152 may be angled at an angle 1202. In one specific example, angle 1202 may range be range from approximately 20° to approximately 75°. However, additional or alternative implementations of the hook structure 152 may be utilized, including an angle 1202 outside of the range of 20° to 75°, without departing from the scope of these disclosures.

Figure 13:
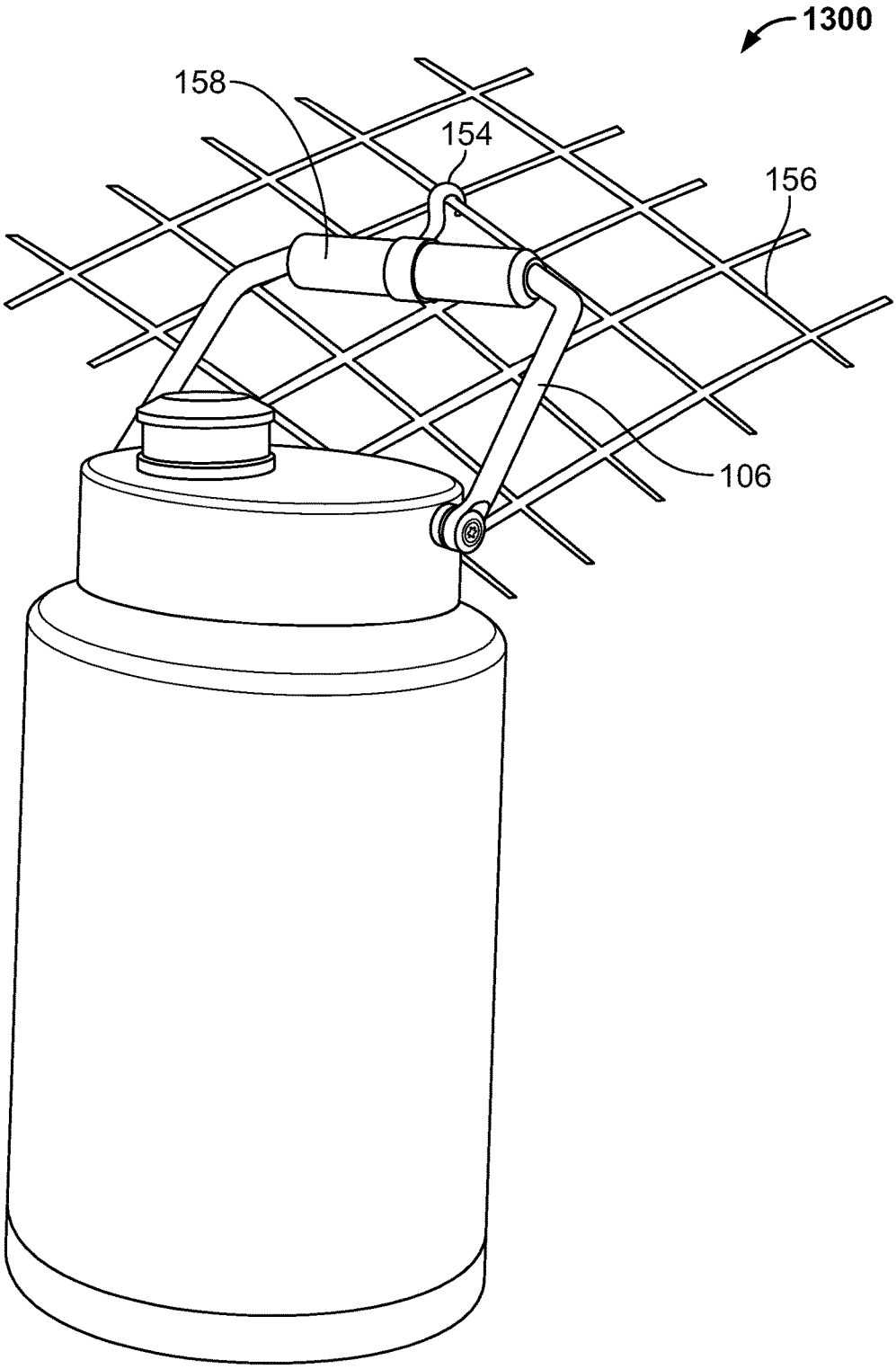
FIG. 13 depicts an isometric view of another example container structure, according to one or more aspects described herein.

FIG. 13 depicts another example implementation of a container 1300. Accordingly, container 1300 may be similar to containers 100, 300, and 1200 where similar reference numerals represent similar components and features. In this example implementation, container 1300 may have a hook structure 154, which may be positioned as a center of a grip structure 158 of the carry handle structure 106, and such that the container 100 may be hung from a chain-link fence 156, among others. Accordingly, hook structure 152 and hook structure 154 may be constructed from one or more metals, alloys, or polymers, without parting from the scope of the disclosures described herein.

According to one aspect, an insulating container may have a canister that has an insulated double wall with a first end to support the canister on a surface, a second end, and a sidewall. The canister may also have an opening in the second end that extends through the insulated double wall. A neck structure may encircle the opening and extend in an axial direction. A lid may seal the opening by receiving the neck structure into a corresponding opening in the lid. The lid may further have a circular domed top surface having a spout opening, and a removable cap that seals the spout opening. Further, the cap may have a magnetic top surface configured to be magnetically attracted to, and retained within, a dimple on the domed top surface.

According to another aspect, a container may have a bottom portion with a first end, a second end having an opening, and a cylindrical wall spaced between the first and the second end. The bottom portion may taper from a first outer diameter at the first end, to a second, smaller outer diameter at the second end. The bottom portion may further have a neck structure around the opening. Additionally, the container may have a lid that seals the opening, the lid further having an opening to receive the neck structure. A top surface of the lid may have a spout opening, and a removable cylindrical cap that seals the spout opening. The removable cylindrical cap may have a magnetic top surface. Additionally, the top surface may have a recess with a magnetic surface that magnetically couples to the magnetic top surface of the cylindrical cap when removed from the spout.

In yet another aspect, a container may have an insulated base structure with a cylindrical shape and an opening in one end. The container may also have a lid with a bottom surface that seals the insulated base structure. A top surface of the lid may have a spout, and a cap that removably couples to, and seals, the spout. The cap may have a magnetic top surface.

Additionally, the lid may have at least one ferromagnetic piece, and a carry handle. Further, a tilt angle between a central axis of the spout and the bottom surface of the lid may be less than 90°.

Figure 14:
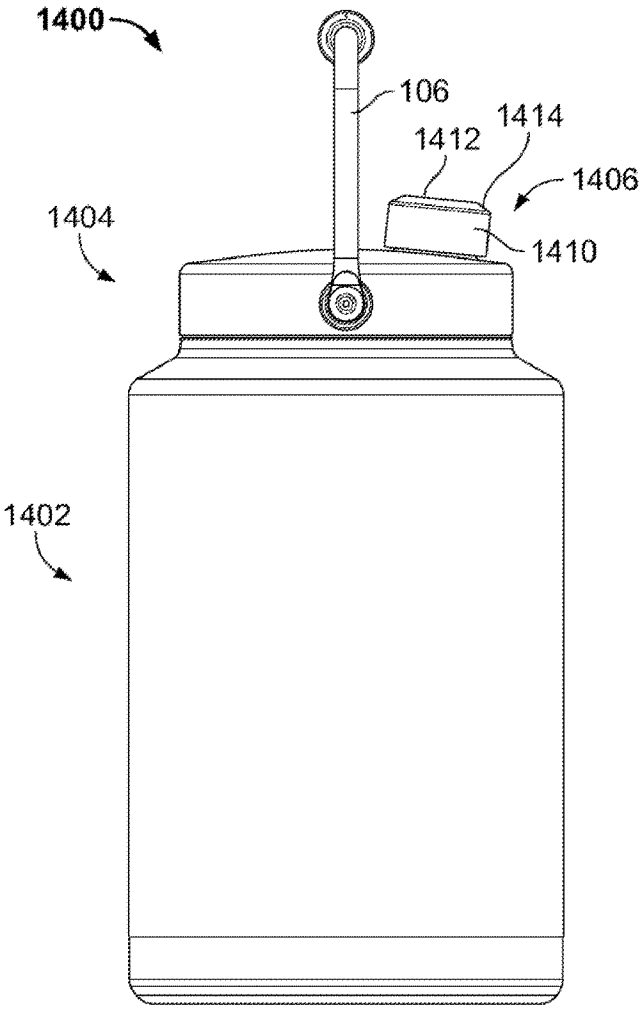
FIG. 14 depicts another implementation of a container structure, according to one or more aspects described herein.

FIG. 14 depicts another implementation of a container 1400, according to one or more aspects described herein. In one example, container 1400 may comprise a bottom portion 1402 having a lid 1404 removably-coupled thereto. Further, the bottom portion 1402 may be referred to as a canister, base, or insulated base structure that has a substantially cylindrical shape, among others. Carry handle 106 may be rotatably-coupled to the lid 1404. Additionally, the lid 1404 may comprise a cap 1406 that is configured to removably-coupled to, and resealably seal a spout opening 1408 (as depicted in FIG. 15) of the lid 1404.

In various examples, the cap 1406 may have a substantially cylindrical side wall 1410 separated from a substantially circular magnetic top surface 1412 by a chamfered surface 1414, as depicted in FIG. 14. Accordingly, the chamfered surface 1414 may be similar to surface 143, as depicted FIG. 8. As such, the chamfered surface 1414 may be configured to center the magnetic top surface 1412 of the cap 1406 within the dimple/depression 1416 (as depicted in FIG. 15). In this way, the dimple 1416 may have complementary geometry configured to receive the magnetic top surface 1412 and chamfered surface 1414 of cap 1406.

Figure 15:
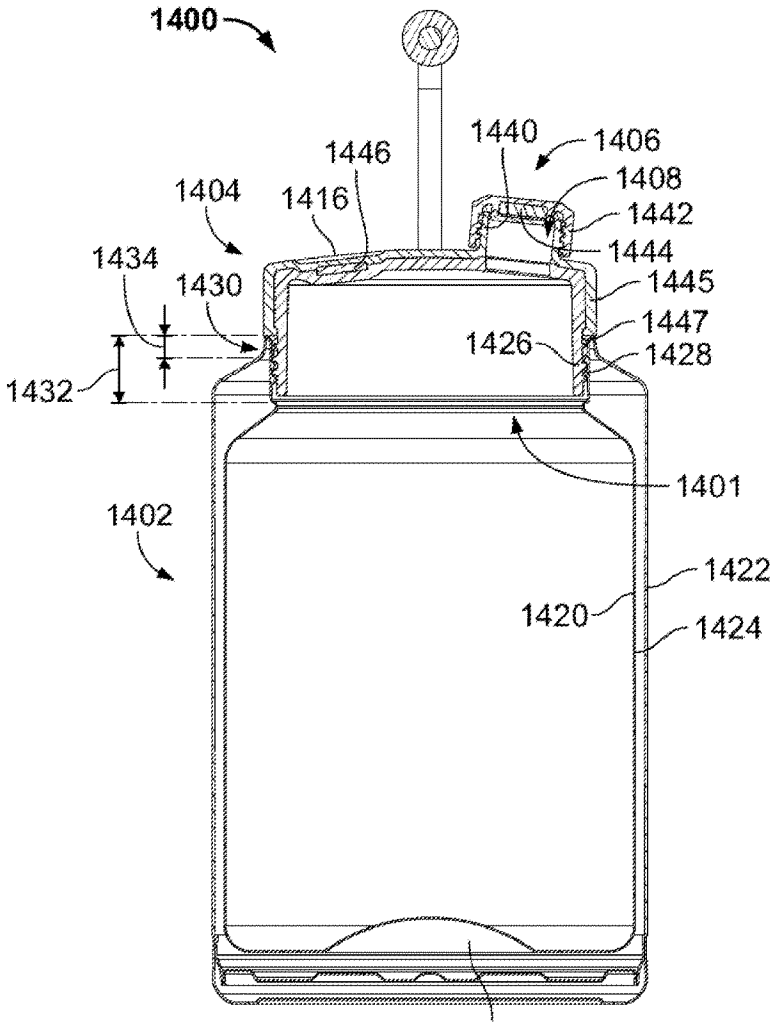
FIG. 15 depicts a cross-sectional view of the container of FIG. 14, according to one or more aspects described herein.

FIG. 15 depicts a cross-sectional view of container 1400. Accordingly, the bottom portion 1402 may comprise a concave structure 1418, similar to concave structure 181 of bottom portion 102. Further, the bottom portion 1402 may have an insulated double wall structure comprising an inner wall 1420 and an outer wall 1422. As such, a sealed vacuum cavity 1424, similar to vacuum cavity 180, may be positioned between the inner wall 1420 and the outer wall 1422. In other implementations, the cavity 1424 may be filled with one or more insulating materials.

In one implementation, the lid 1404 is configured to resealably seal an opening 1401 in the bottom portion 1402. Accordingly, a threaded wall 1426 of the lid 1404 may be received by a threaded sidewall 1428 of the bottom portion 1402 to removably-couple the lid 1404 to the bottom portion 1402.

In various implementations, the bottom portion 1402 may have a neck structure 1430, and such that the threaded sidewall 1426 extends into the bottom portion 1402 to a depth 1432, greater than a height 1434 of the neck structure 1430. As such, the threaded sidewall 1428 may be configured to receive the threaded sidewall 1426 such that the neck structure 1430 abuts/is positioned proximate an outer wall 1445 of the lid 1404 at end 1447.

The spout opening 1408 may be embodied with a threaded sidewall 1440 configured to receive a threaded sidewall 1442 of cap 1406 to removably-couple the cap 1406 to the lid 1404.

A magnetic material 1444, such as, among others, a ferromagnetic plate that is not magnetized, or a permanent magnet, may be positioned below the magnetic top surface 1412 of the cap 1406. In this way, magnetic material 1444 may be similar to magnet 173 from FIG. 4. Similarly, a magnetic material 1446 may be positioned below the dimple 1416. As such, dimple 1416 may be similar to dimple 130.

In addition to the various elements described in relation to container 1400 and depicted in FIG. 14 and FIG. 15, container 1400 may comprise one or more additional or alternative elements described in relation to containers 100 or 300, without departing from the scope of these disclosures.

Figure 16:
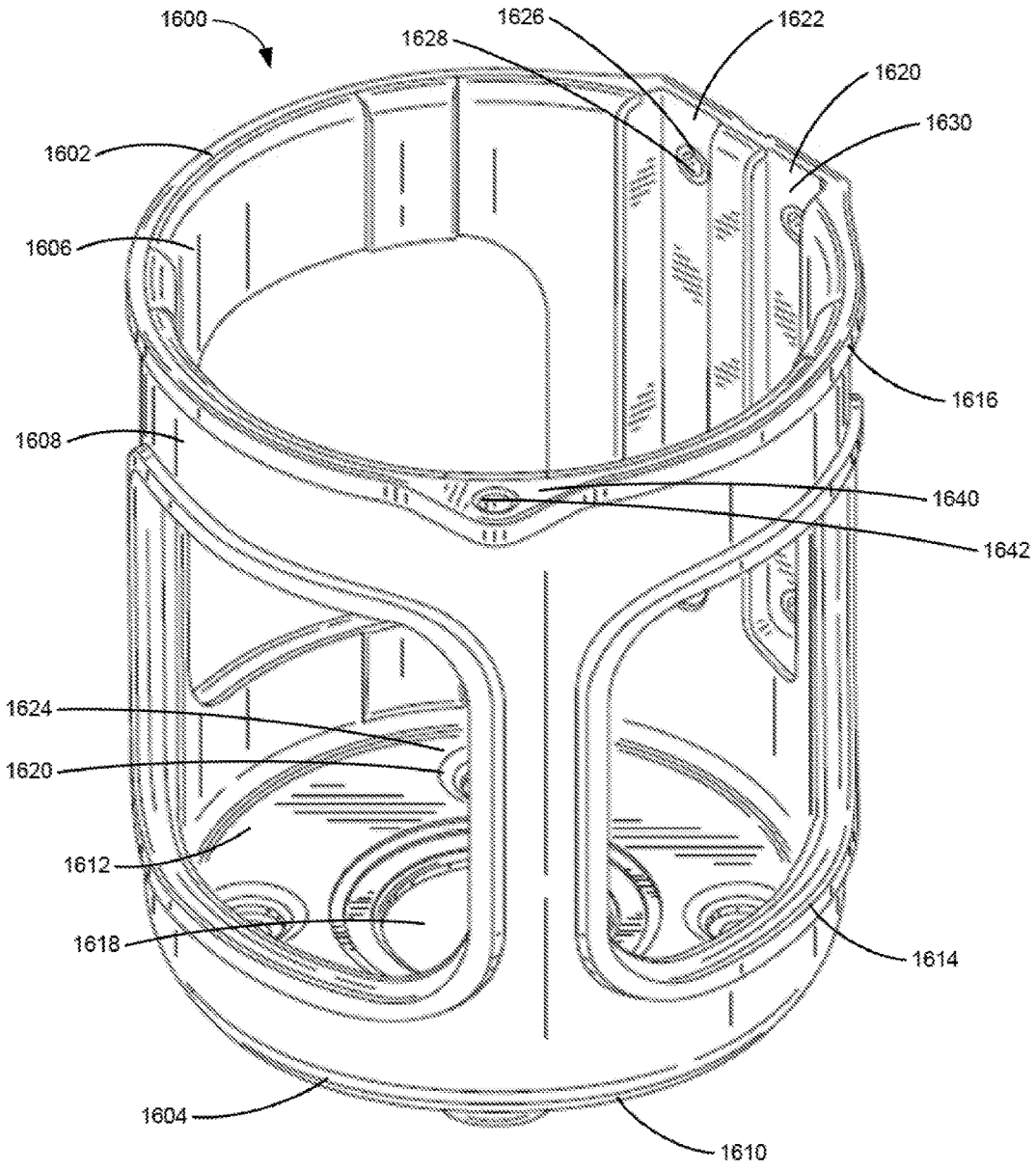
FIG. 16 depicts an isometric view of an example container holder, according to one or more aspects described herein.
Figure 17:
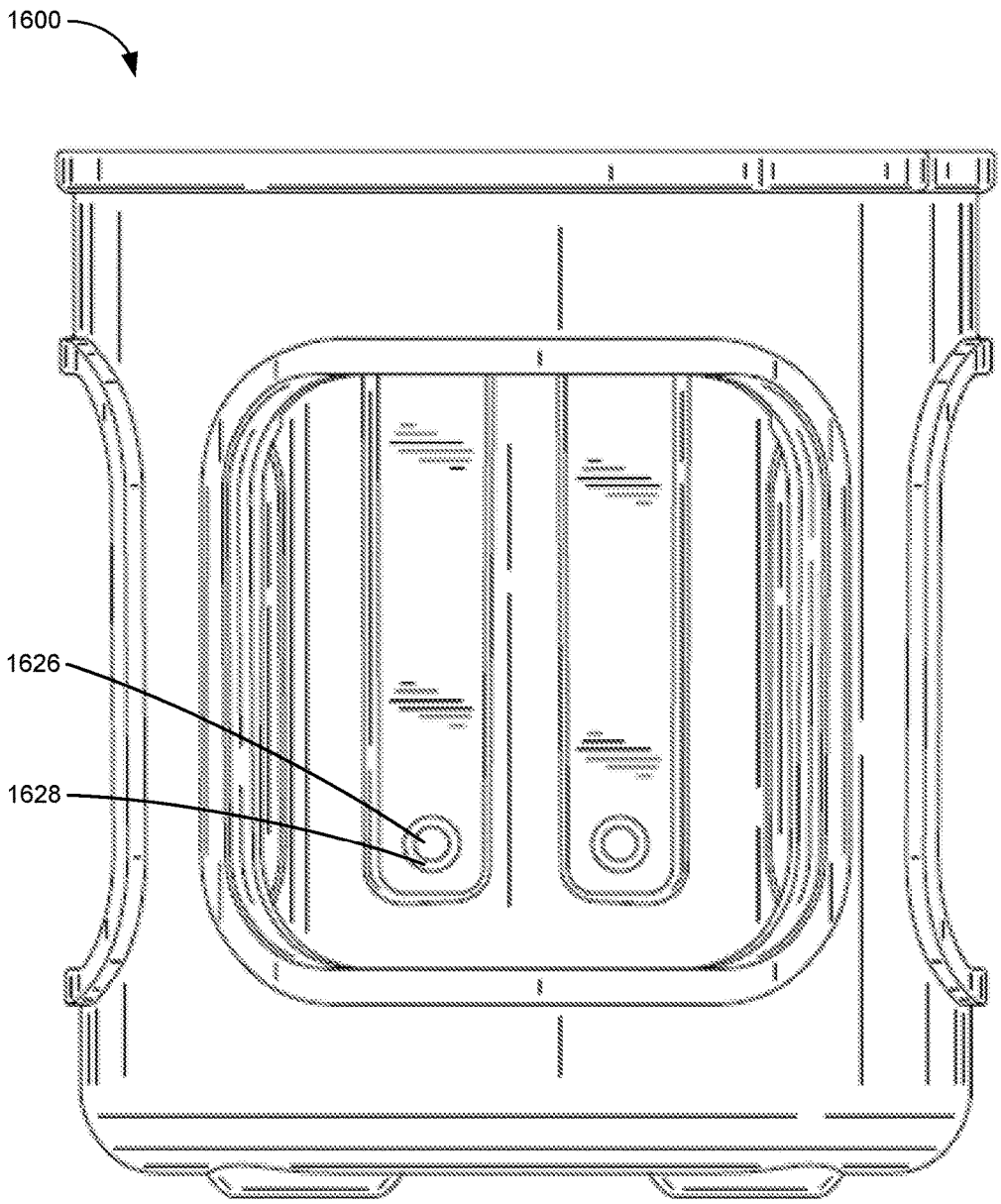
FIG. 17 depicts a front side view of the container holder of FIG. 16, according to one or more aspects described herein.
Figure 18:
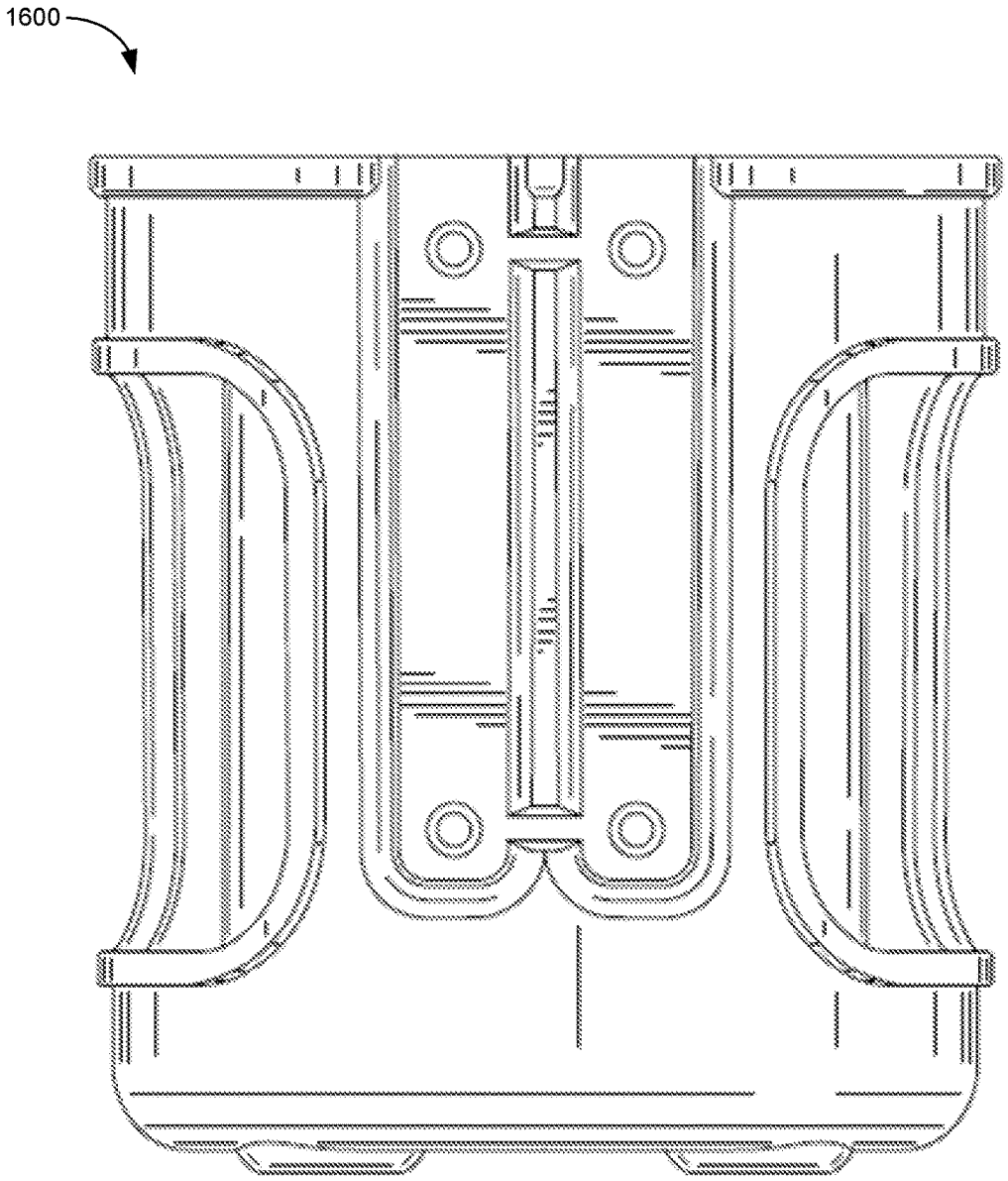
FIG. 18 depicts a back side view of the container holder of FIG. 16, according to one or more aspects described herein.
Figure 20:
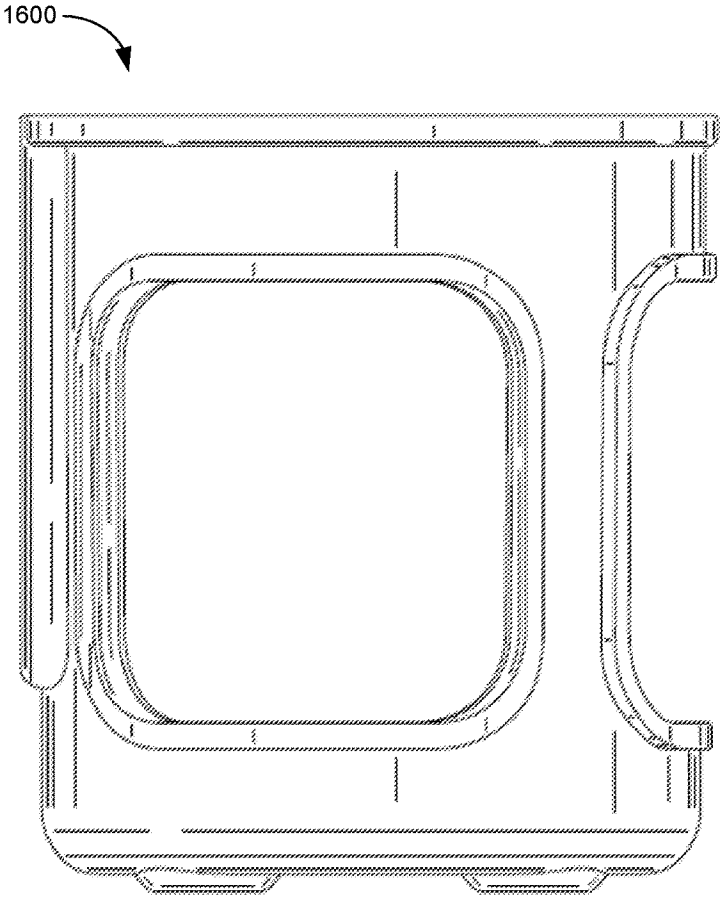
FIG. 20 depicts a right side view of the container holder of FIG. 16, according to one or more aspects described herein.
Figure 19:
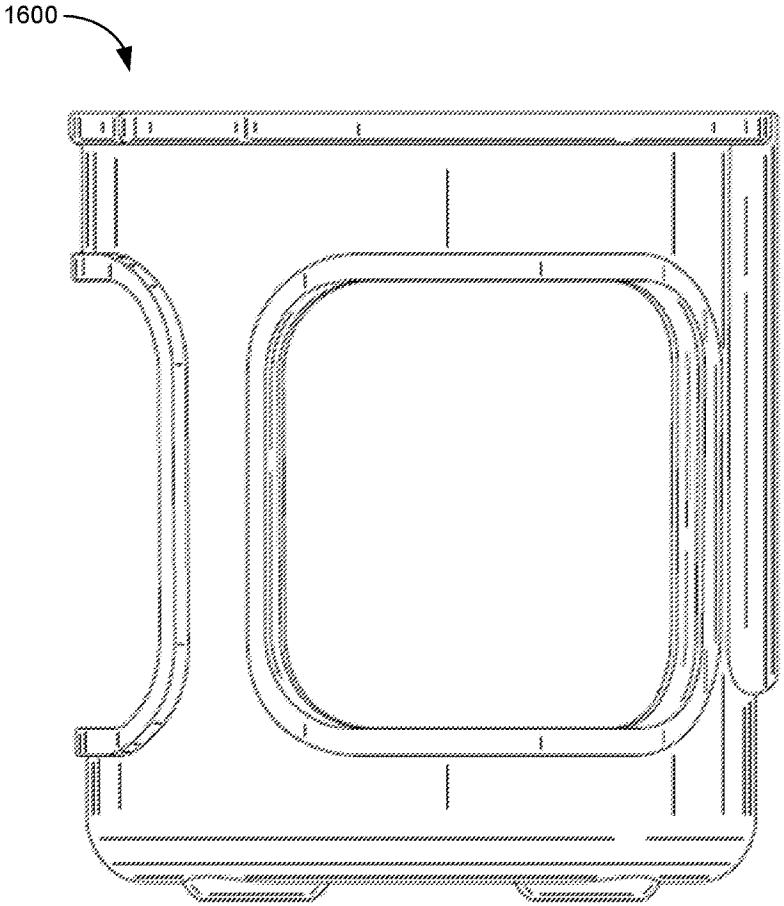
FIG. 19 depicts a left side view of the container holder of FIG. 16, according to one or more aspects described herein.
Figure 22:
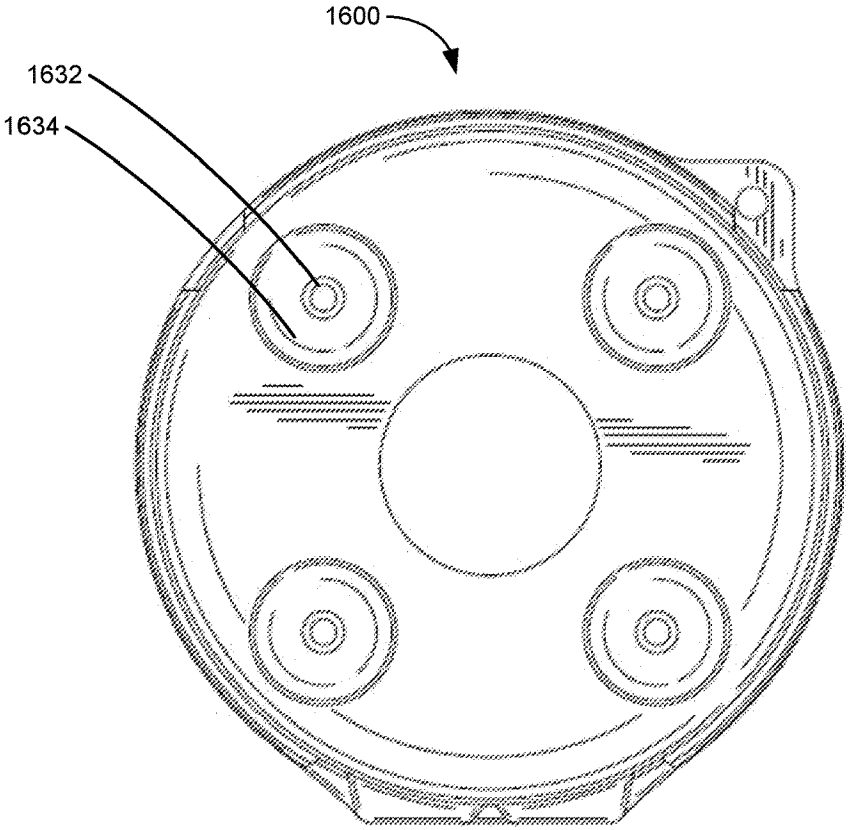
FIG. 22 depicts a bottom side view of the container holder of FIG. 16, according to one or more aspects described herein.
Figure 21:
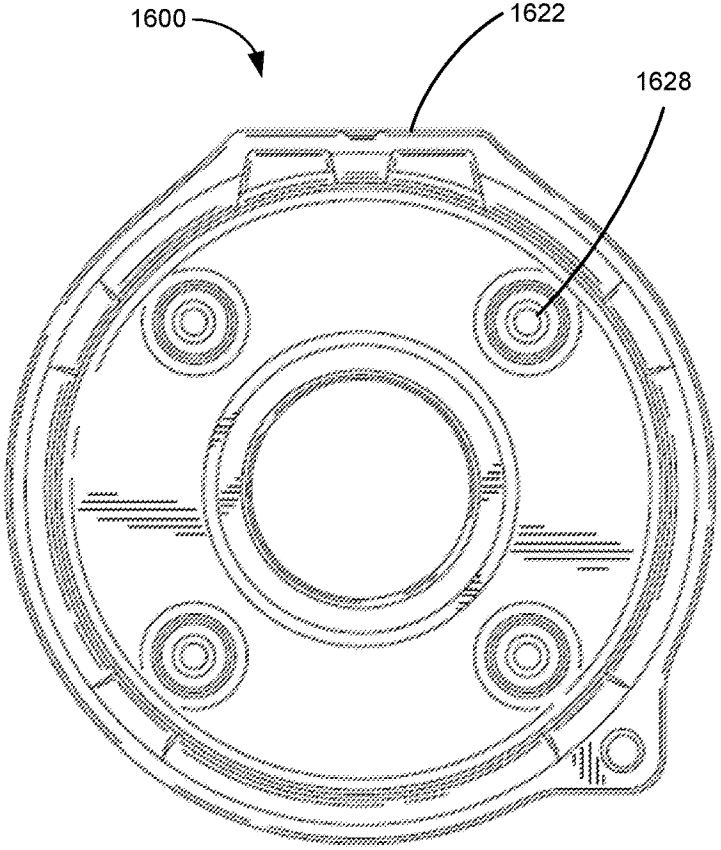
FIG. 21 depicts a top side view of the container holder of FIG. 16, according to one or more aspects described herein.

In some embodiments the containers (e.g. container 100) described herein, may include a container holder 1600. FIG. 16 depicts an isometric view of an exemplary container holder 1600. The holder 1600 may have a top end 1602 and bottom end 1604 and may comprise a structure having a substantially cylindrical shape with an opening 1606 in the top end 1602 as shown in FIG. 16. In other examples to that implementation depicted in FIG. 16, the holder 1600 may be a substantially cuboidal, or prismoidal (e.g. a pentagonal prism, hexagonal prism, heptagonal prism, among others) in shape. In still other examples the holder 1600 may have an internal shape corresponding to the external shape of a container.

As shown in FIG. 16, the holder 1600 may have a holder sidewall portion 1608 and a holder base portion 1610. As shown in FIG. 16, the holder sidewall portion 1608 may be substantially cylindrical. However, as will be discussed in greater detail below, the sidewall 1608 may include one or more mounting portions that are substantially flat and may be used for mounting the holder 1600 to another surface.

As shown in FIG. 16 (and FIG. 24) the holder sidewall 1608 may form an outer perimeter around a container 100. While, the holder sidewall 1608 may form an entire perimeter around a container, in some embodiments, the holder sidewall 1608 may only extend partially around the container. In some embodiments the holder sidewall 1608 may include at least one window, or a plurality of windows 1612. For example, as shown in FIG. 16, the holder 1600 may contain three windows 1612. Further, in some embodiments, and as shown in FIG. 16, the windows 1612 may each contain a raised ridge 1614 around an outer edge of the window 1612. Advantageously the raised ridge may increase the strength of the holder 1600 while only minimally increasing material usage. In some embodiments the holder sidewall 1608 may also include a raised ridge 1616 along the top end 1602. Similarly, this raised ridge 1616 may increase the strength of the holder 1600 while only minimally increasing material usage. Additionally, in some embodiments the holder base 1604 may include one or more windows 1618.

The holder 1600 may be configured to be mounted to another surface and thus may include one or more mounting portions 1620. As shown in FIG. 16, the holder 1600 may include a sidewall mounting portion 1622 and/or a base mounting portion 1624. Referring first to the sidewall mounting portion 1622, the holder sidewall 1608 may include substantially flat portions in the sidewall mounting portion 1622 for mounting of the holder 1600 to a substantially flat surface. As shown in FIG. 16, the sidewall mounting portion 1622 may contain a plurality of sidewall mounting apertures 1626. The sidewall apertures 1626 may be sized to accept a mechanical fastener such as a screw, nail, or other device for mounting of the holder 1600 to a surface. In some embodiments, the aperture 1626 may also contain a compression limiter 1628. The compression limiter may be formed of metal or similar materials and may be pressed into the aperture 1626 such that it is permanently engaged with the holder 1600. Advantageously, the compression limiters 1628, may allow the aperture 1626 to be stronger than other portions of the holder such that the holder may be mounted and un-mounted multiple times to multiple surfaces without damaging the holder 1600. The sidewall mounting portion 1622 may also include one or more cutouts 1630 to accommodate the mechanical fasteners used to mount the holder 1600. As shown in FIG. 16, the cutouts 1630 may form a continuous area between mounting apertures 1626, or the cutouts 1630 may only be formed in an area directly around the mounting aperture 1626.

Similarly the base mounting portion 1624, may include one or more, or a plurality of, base apertures 1632 for mounting the holder 1600 to a surface. As shown in FIG. 16, the holder 1600 may also include mounting feet 1634 surrounding the apertures 1632. The base apertures 1632 may be sized to accept a mechanical fastener such as a screw, nail, or other device for mounting of the holder 1600 to a surface. In some embodiments, the aperture 1632, like the sidewall apertures 1626, may also contain a compression limiter 1628. The compression limiter 1628 may be formed of metal or similar materials and may be pressed into the aperture 1632 such that it is permanently engaged with the holder 1600. Advantageously, the compression limiters 1628, may allow aperture 1632 area to be stronger than other portions of the holder such that the holder may be mounted an un-mounted multiple times to multiple surfaces without damaging the holder 1600.

Figure 23:
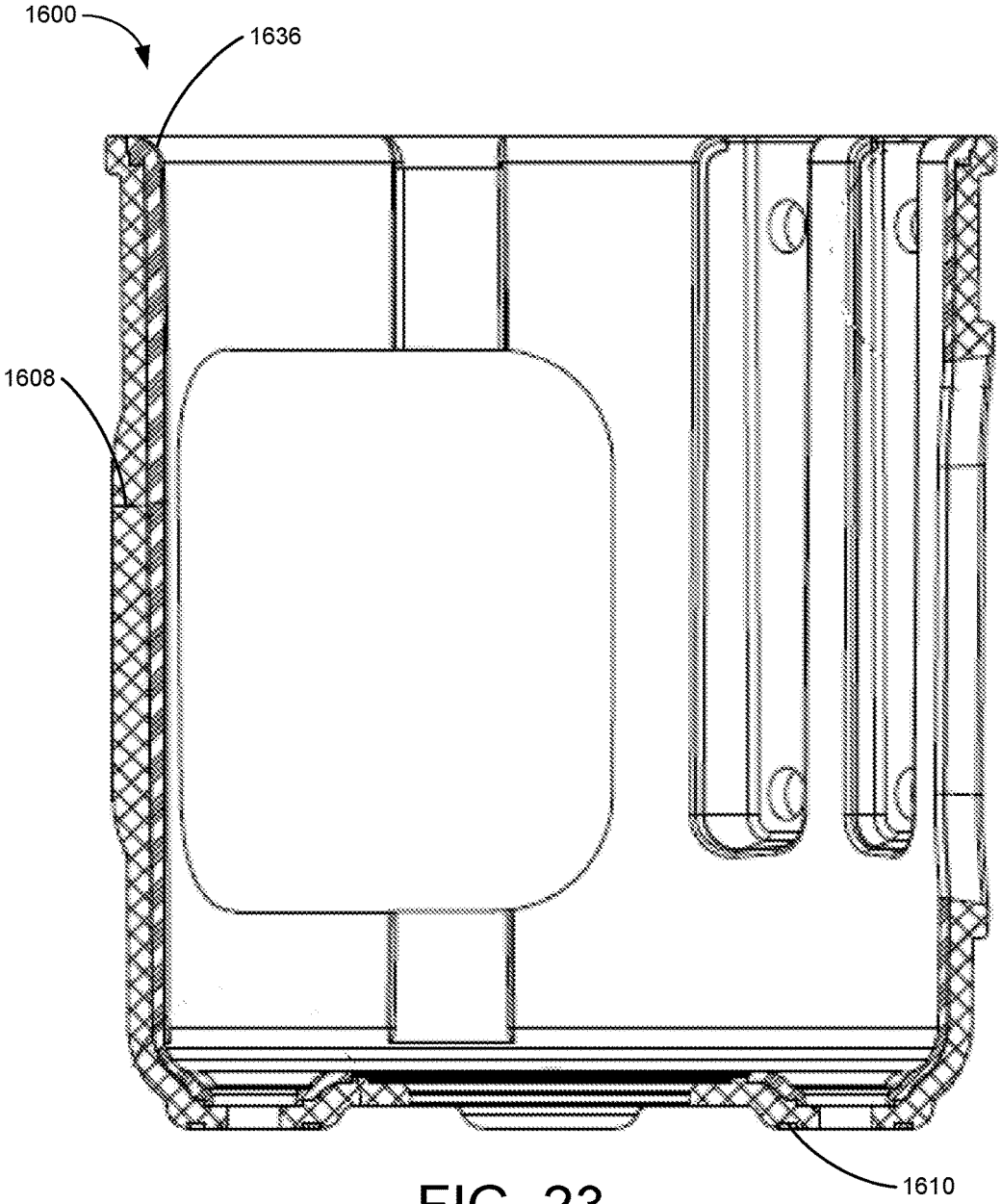
FIG. 23 depicts a cross-sectional sectional view of an example container holder, according to one or more aspects described herein.
Figure 24:
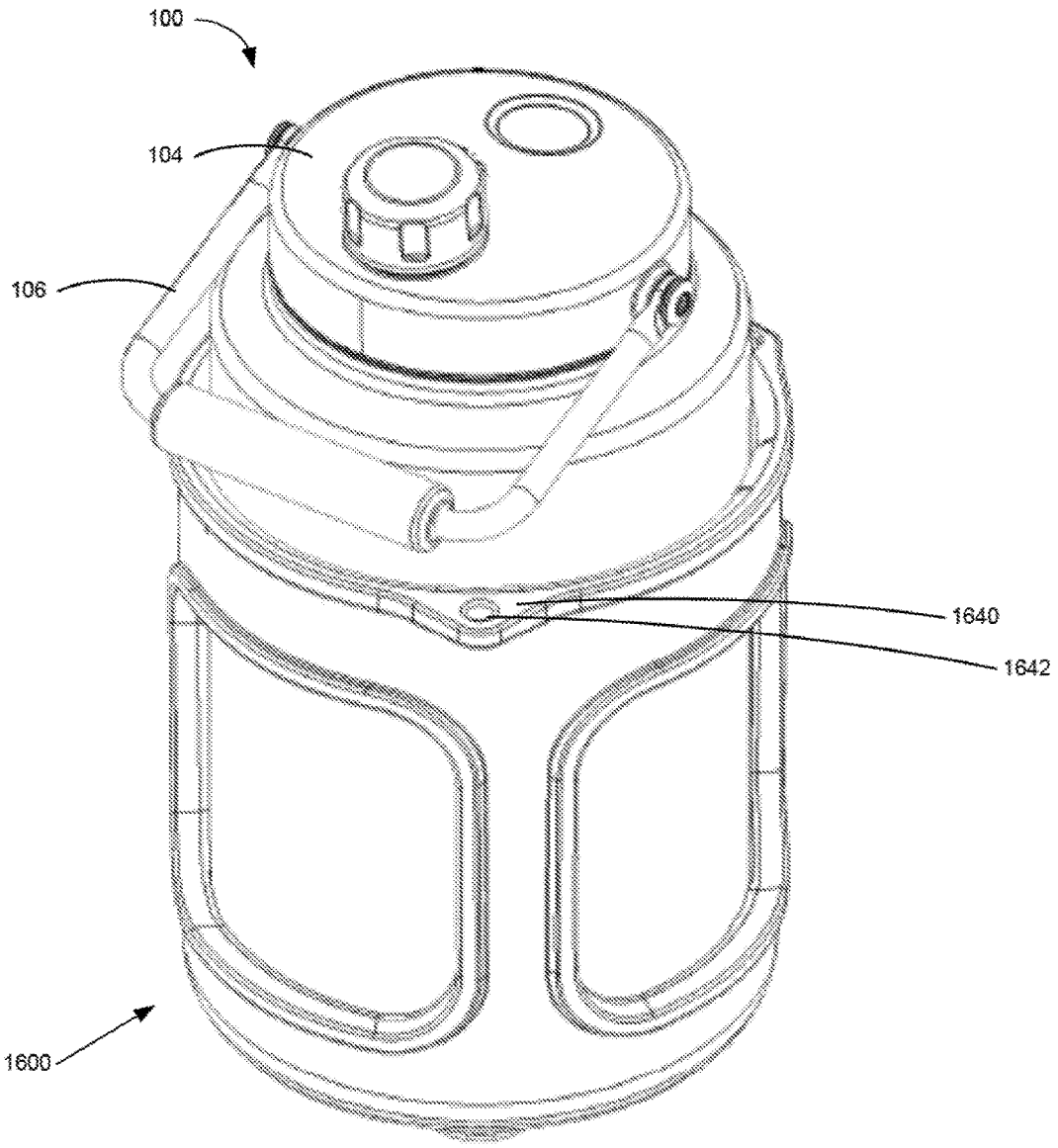
FIG. 24 depicts an isometric view of an example container and container holder, according to one or more aspects described herein.

As described above, the holder 1600 may be engaged with containers (e.g. container 100) described herein. As shown in FIG. 24, the container 100 may be inserted into the holder 1600, and the inner diameter of the holder sidewall may be greater than the outer diameter of the sidewall of the container. In other embodiments, an inner surface of the holder sidewall 1608 may be flexible such that one or more portions of the inner diameter of the holder sidewall 1608 may be smaller than the outer diameter of the sidewall of the container. In such configurations the holder sidewall 1608 may be flexible to accept larger containers. For example, as shown in cross-sectional view, FIG. 23, the holder 1600 may include an engagement layer 1636 disposed on an inner surface of the holder sidewall 1608 and/or the holder base 1610. As shown in FIG. 24, the holder sidewall 1608 and holder base 1610 may be comprised of a first material and the engagement layer 1636 comprised of a second material. The first and second materials may be different materials.

Figure 25:
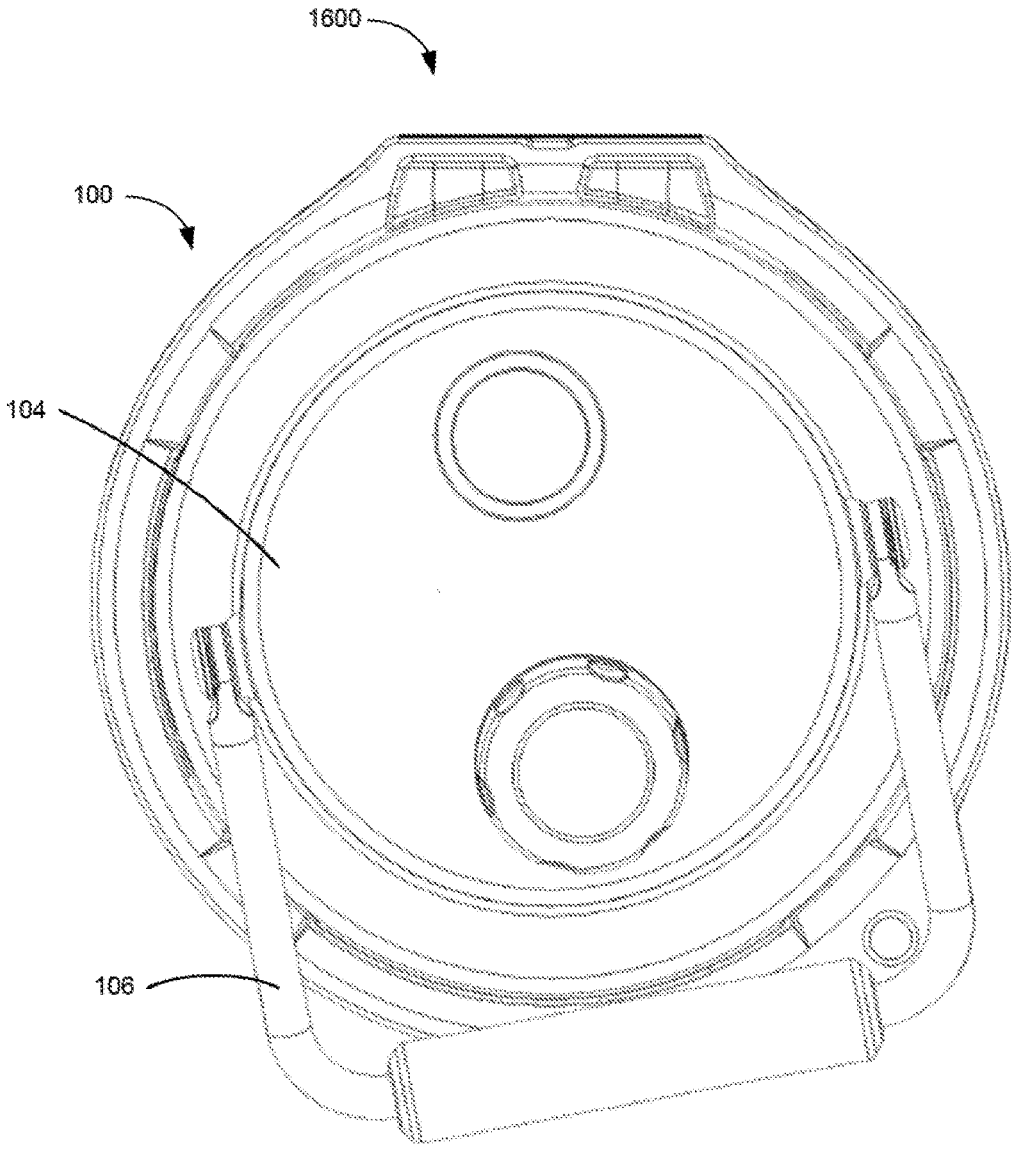
FIG. 25 depicts a top side view of the container and container holder of FIG. 24, according to one or more aspects described herein.
Figure 26:
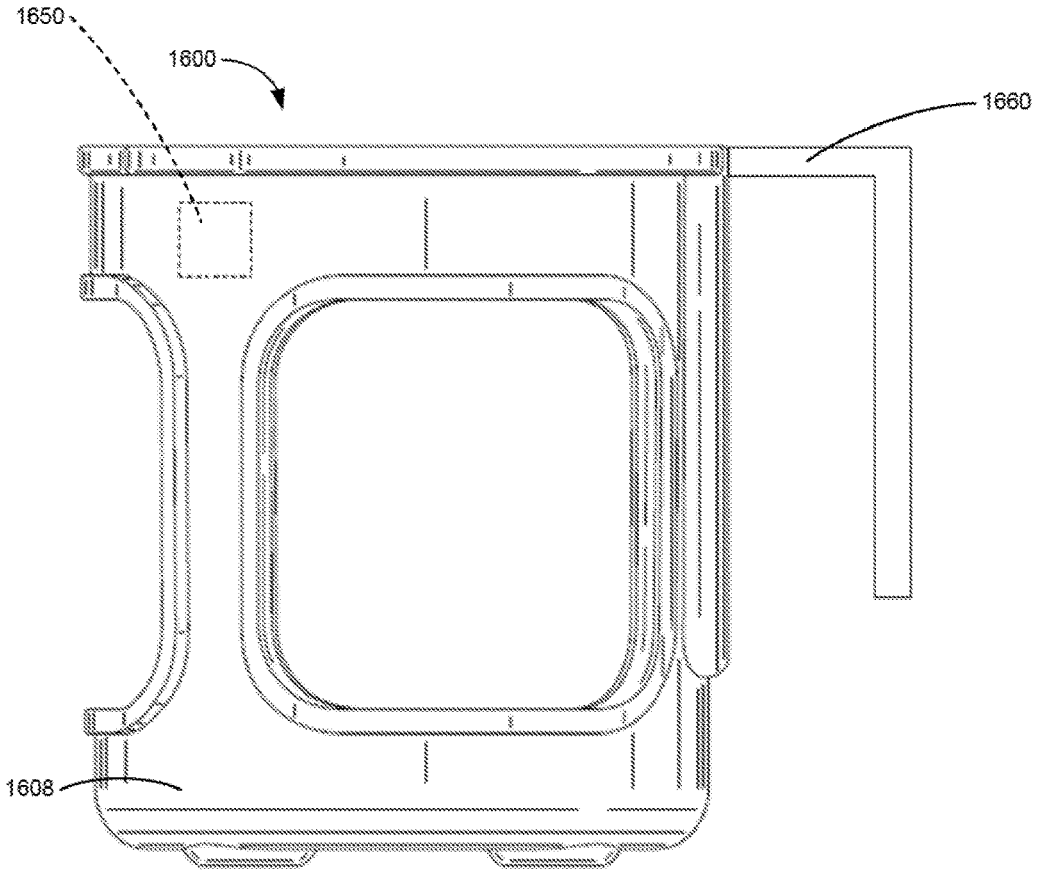
FIG. 26 depicts a left side view of the container holder, according to one or more aspects described herein.

Further, in some embodiments, the holder 1600 may include a locking tab 1640. The locking tab 1640 may extend from the holder sidewall 1608 on the top end 1602 as shown, for example, in FIGS. 16 and 24. The locking tab 1640 may include a locking aperture 1642. As described above, in various examples, the container lid 104 may comprise a carry handle structure 106 rotatably coupled to the lid 104. The carry handle 106 may be rotated to a variety of positions including a downward position as shown in FIG. 24. As shown in FIG. 25, the container 102 and holder 1600 may form a vertical opening passing through the locking aperture 1642 and the carry handle 106 when the carry handle 106 is in a downward position. Advantageously, the vertical opening through the carry handle 106 and the locking aperture 1642 may allow for a lock to be fastened to the holder 1600 and the handle 106 which may allow for the container 100 to be locked to the holder 1600.

The holder 1600 described herein may be formed using any process. In one example the holder 1600, may be formed using injection molding processes. In some embodiments, the holder 1600 may be formed using a single shot injection molding process. In other embodiments, the holder 1600 may be formed in a two shot injection molding process wherein the majority of the holder 1600 is formed with a first shot and the engagement layer 1636 is overmolded or formed in a second shot. Additionally, the holder 1600 may be formed using a gas assist injection molded process wherein gas such as nitrogen gas is injected into the interior of a mold. This process may form hollow portions within the holder 1600. This process may reduce material usage and total weight of the holder 1600. The holder 1600 may be formed of rubber, materials including rubber, plastics, elastomers, thermoplastic elastomers (TPE), and polypropylene (PP). In some embodiments, the holder sidewall 1608 and holder base 1610 may be formed of polypropylene and the engagement layer 1636 may be formed of thermoplastic elastomer (TPE). In some embodiments holder 1600 may be constructed of a material having a thermal conductivity of about 0.1 W/(m*K) to about 0.22 W/(m*K).

The holder 1600, may in other embodiments contain any number of additional features. For example, in some embodiments, the holder 160, may include a magnetic surface 1650. The magnetic surface may be embedded within the holder sidewall 1608 or may be located on an outer surface of the sidewall 1608. The magnetic surface 1650 may be used to hold the container cap or other items. Additionally, in some embodiments, the holder 1600 may include a clip 1660 extending from the holder sidewall 1608. The clip 1660 may be integrally formed with the holder 1600 in some embodiments, or may be removably engaged with the holder 1600 in some embodiments. The clip 1660 may be used to attach the holder to a number of different items, including for example the exterior of a cooler body.

The present disclosure is disclosed above and in the accompanying drawings with reference to a variety of examples. The purpose served by the disclosure, however, is to provide examples of the various features and concepts related to the disclosure, not to limit the scope of the invention. One skilled in the relevant art will recognize that numerous variations and modifications may be made to the examples described above without departing from the scope of the present disclosure.

We claim:

1. A container and holder system, comprising:

a canister comprising:
- an insulated double wall structure comprising:
  - a first end, configured to support the canister on a surface;
  - a second end; and
  - a sidewall, the sidewall having an outer diameter;
- an opening in the second end extending through the insulated double wall structure; and
- a neck structure encircling the opening and extending in an axial direction;

a lid adapted to seal the opening, the lid comprising:
- a threaded sidewall configured to be received into the neck structure;
- a carry handle, the carry handle rotatably-coupled to a cylindrical side wall of the lid;

a holder comprising:
- a holder sidewall having a top end and a bottom end, the holder sidewall having an inner diameter, wherein the holder sidewall is formed from a plastic or elastomeric material and comprises a plurality of sidewall mounting apertures, and wherein each of the plurality of sidewall mounting apertures contains a compression limiter, wherein the compression limiter is formed from a metallic material;
- a holder base extending from the bottom end of the holder sidewall;
- a locking tab extending from the holder sidewall, the locking tab containing a locking aperture;
- wherein the inner diameter of the holder sidewall is greater than the outer diameter of the sidewall of the insulated double wall structure; and wherein when the carry handle of the lid is in a downward position, the carry handle forms a vertical opening configured to allow a lock to pass through the vertical opening and the locking aperture to lock the lid to the holder.

2. The container and holder system of claim 1, wherein the holder base comprises a plurality of base mounting apertures, and wherein each of the plurality of base mounting apertures contains a compression limiter.

3. The container and holder system of claim 2, wherein the holder further comprises an engagement layer disposed on an inner surface of the holder sidewall, the holder sidewall comprised of a first material and the engagement layer comprised of a second material.

4. A container and holder system, comprising:

a canister comprising:

an insulated double wall structure comprising:

a first end, configured to support the canister on a surface;

a second end; and a sidewall, the sidewall having an outer diameter;

an opening in the second end extending through the insulated double wall structure; and a neck structure encircling the opening and extending in an axial direction;

a lid adapted to seal the opening, the lid comprising:

a threaded sidewall configured to be received into the neck structure;

a carry handle, the carry handle rotatably-coupled to a cylindrical side wall of the lid;

a holder comprising:

a holder sidewall having a top end and a bottom end, the holder sidewall having an inner diameter; wherein the holder sidewall comprises at least one sidewall window, wherein the at least one sidewall window is bounded on all sides by the holder sidewall;

wherein the holder sidewall is formed from a plastic or elastomeric material and comprises a plurality of sidewall mounting apertures, and wherein each of the plurality of sidewall mounting apertures contains a compression limiter, wherein the compression limiter is formed from a metallic material;

a holder base extending from the bottom end of the holder sidewall; and wherein the inner diameter of the holder sidewall is greater than the outer diameter of the sidewall of the insulated double wall structure.

5. The container and holder system of claim 4, wherein the at least one sidewall window comprises a plurality of sidewall windows.

6. The container and holder system of claim 4, wherein the holder base comprises at least one base window.

7. The container and holder system of claim 4, wherein the holder base comprises a plurality of base mounting apertures.

8. The container and holder system of claim 7, wherein each of the plurality of base mounting apertures contains a compression limiter.

9. The container and holder system of claim 4, wherein the holder sidewall has a raised ridge along the top end.

10. The container and holder system of claim 5, wherein the holder sidewall has a raised ridge along an edge of each of the plurality of sidewall windows.

11. The container and holder system of claim 4, wherein the holder further comprises an engagement layer disposed on an inner surface of the holder sidewall, the holder sidewall comprised of a first material and the engagement layer comprised of a second material.

12. The container and holder system of claim 4, further comprising a locking tab extending from the holder sidewall, the locking tab containing a locking aperture.

13. The container and holder system of claim 12, wherein when the carry handle of the lid is in a downward position, the carry handle forms a vertical opening configured to allow a lock to pass through the vertical opening and the locking aperture to lock the lid to the holder.

14. The container and holder system of claim 4, wherein the holder comprises a magnetic plate positioned on the holder sidewall.

15. The container and holder system of claim 4, wherein the holder comprises a clip extending from the holder sidewall.

16. A holder for a container, comprising:

a holder sidewall having a top end and a bottom end, the holder sidewall having an inner diameter;

a holder base extending from the bottom end of the holder sidewall;

a locking tab extending from the holder sidewall, the locking tab containing a locking aperture;

wherein the holder sidewall comprises a plurality of sidewall windows, wherein each sidewall window of the plurality of sidewall windows is bounded on all sides by the holder sidewall;

wherein the holder base comprises at least one base window;

wherein the holder sidewall comprises a plurality of sidewall mounting apertures, and wherein each of the plurality of sidewall mounting apertures contains a compression limiter;

wherein the holder sidewall is formed from a plastic or elastomeric material, and wherein the compression limiter is formed from a metallic material;

wherein the holder base comprises a plurality of base mounting apertures, and wherein each of the plurality of base mounting apertures contains a compression limiter;

wherein the holder sidewall has a raised ridge along the top end;

wherein the holder sidewall has a raised ridge along an edge of each of the plurality of sidewall windows; and wherein the holder further comprises an engagement layer disposed on an inner surface of the holder sidewall, the holder sidewall comprised of a first material and the engagement layer comprised of a second material.

* * * * *